United States Patent [19]

Kawasaki et al.

[11] Patent Number: 4,840,888

[45] Date of Patent: Jun. 20, 1989

[54] LIGHT-SENSITIVE SILVER HALIDE PHOTOGRAPHIC MATERIAL

[75] Inventors: Mikio Kawasaki; Hiroaki Shiozawa; Kakujulo Fukuouji; Kouji Ono, all of Hino, Japan

[73] Assignee: Konishiroku Photo Industry Co., Ltd., Tokyo, Japan

[21] Appl. No.: 266,211

[22] Filed: Oct. 27, 1988

Related U.S. Application Data

[63] Continuation of Ser. No. 5,489, Jan. 20, 1987, abandoned.

[30] Foreign Application Priority Data

Jan. 22, 1986 [JP] Japan ..... 61-11427
Mar. 18, 1986 [JP] Japan ..... 61-61190

[51] Int. Cl.[4] ..... G03C 5/26; G03C 1/10

[52] U.S. Cl. ..... 430/567; 430/596; 430/599; 430/414; 430/415

[58] Field of Search ..... 430/596, 567, 414, 415, 430/416, 599, 607

[56] References Cited

U.S. PATENT DOCUMENTS

| | | | |
|---|---|---|---|
| 2,996,382 | 8/1961 | Luckey et al. | 430/502 |
| 3,650,759 | 3/1972 | Sonoda et al. | 430/599 |
| 4,357,419 | 11/1982 | Sills | 430/607 |
| 4,427,762 | 1/1984 | Takahashi et al. | 430/436 |
| 4,521,508 | 6/1985 | Sagimoto et al. | 430/567 |
| 4,604,339 | 8/1986 | Sagimoto et al. | 430/244 |
| 4,631,253 | 12/1986 | Mifune et al. | 430/611 |
| 4,693,956 | 9/1987 | Marchesano | 430/599 |

FOREIGN PATENT DOCUMENTS 116535 7/1983 Japan .

*Primary Examiner*—Richard L. Schilling
*Attorney, Agent, or Firm*—Frishauf, Holtz, Goodman & Woodward

[57] ABSTRACT

There is disclosed a light-sensitive silver halide photographic material having at least one silver halide emulsion layer on a support, which comprises the light-sensitive photographic material contains light-sensitive silver halide grains, metal salt grains having internal fog and a polyhydric alcohol having at least two hydroxyl groups having a melting point of 40° C. or higher.

12 Claims, No Drawings

LIGHT-SENSITIVE SILVER HALIDE PHOTOGRAPHIC MATERIAL

This application is a continuation of application Ser. No. 07/005,489, filed Jan. 20, 1987, now abandoned.

BACKGROUND OF THE INVENTION

This invention relates to a novel light-sensitive silver halide photographic material, more particularly to a light-sensitive silver halide photographic material capable of giving an image of high sensitivity, high contrast and high maximum density.

The present invention further relates to a high sensitivity light-sensitive silver halide photographic material, particularly a high sensitivity light-sensitive silver halide photographic material which is rapid in developing speed, low in fog and also excellent in graininess.

Metallic silver which is indispensable as a starting material for light-sensitive silver halide photographic materials is reducing in its supply, while its demand in various field of industry is increasing, and attempts to save silver for light-sensitive silver halide photographic materials have been actively done.

Also, for the performances of light-sensitive silver halide photographic materials, various requirements have been demanded, and particularly a high sensitivity light-sensitive silver halide photographic material having stable photographic performances have been demanded. In particular, in the light-sensitive material for X-ray, in order to reduce the dose of exposure of X-ray to human body, higher sensitivity is demanded and yet a light-sensitive photographic material of high image quality is requested.

For making sensitivity of the film higher, there is the method of lowering the degree of film hardening of the film layer comprising gelatin, etc. However, according to this method, graininess of the developed image is deteriorated, whereby the properties of the film will be undesirably lowered.

Japanese Provisional Patent Publication No. 89749/1982 discloses a method in which a developing promotor such as a thioether (e.g. $C_6H_{13}OCOCH_2CH_2SCH_2CH_2SCH_2CH_2OCOC_6H_{13}$) or a cyclic compound including nitrogen having a thioketone group, etc., is added in the silver halide emulsion or the developing solution. However, when higher sensitization is attempted to be effected by this method, deterioration of graininess is accompanied and also fog is undesirably increased during storage when it is added in the silver halide emulsion.

The sensitivity can be also made higher by enlarging the grain sizes of the silver halide emulsion, but according to this method, the blackened density per unit developed silver will be lowered, whereby there is the problem that gamma (the gradient at the linear portion of the characteristic curve) is lowered. Accordingly, for obtaining both of high sensitivity and necessary maximum image density, more silver salt must be contained per unit area of the film, and also deterioration of graininess and lowering in covering power will be undesirably accompanied (Japanese Provisional Patent Publication No. 148051/1984).

As one of the attempts to improve covering power while maintaining high sensitivity, the technique of adding various polymers to high sensitivity coarse grain silver halide emulsion is described in U.K. Pats. Nos. 1,048,057 and 1,039,471, U.S. Pats. Nos. 3,043,697 and 3,446,618. All of these techniques have slight effect of enhancing covering power, but they are not satisfactory and also strength of the coated film will be undesirably weakened. Further, this method is great in change of fog with lapse of time, and also development streamer will be readily formed undesirably depending on the development processing method.

Also, there is disclosed the so-called amplification technique in which an organic material which color forms a black coupler imagewise is contained. However, this method is great in deterioration with lapse of time due to the instable organic material contained, and also development streamer will be readily formed undesirably depending on the development processing method.

As a method of high sensitivity and also silver saving, U.S. Pats. Nos. 2,996,382 and 3,178,282 describes a method for obtaining a photographic image of high sensitivity, high contrast and high covering power by use of a light-sensitive silver halide photographic material in which the surface latent iamge type silver halide grains and the silver halide micrograins having fog nuclei internally of grains are permitted to exist adjacent to each other.

However, according to this method, there is involved the drawback that a long time is required for obtaining sufficient photographic characteristic by processing with a conventional developing solution. For overcoming this drawback, the above U.S. Patents describe the method of adding a silver halide solvent to the developing solution. However, by use of this method, fog is increased and graininess is worsened undesirably. Also, the developing solution added with a silver halide solvent is liable to cause increase of fog, lowering in gamma, lowering in maximum density, etc., when a conventional light-sensitive silver halide photographic material is processed, and therefore there is involved the drawback that the developing solution cannot be used commonly.

Further, this method makes the changes in sensitivity and gradation in high temperature processing (processing at a temperature of 30° C. or higher) greater to give no stable photographic performance. As the technique for improving this problem, Japanese Provisional Patent Publication No. 166944/1985 describes a use example of meso-ionic triazolium compound, but desensitization is undesirably accompanied by use of this compound alone.

SUMMARY OF THE INVENTION

An object of the present invention is to solve the problems of the prior art as described above and provide a light-sensitive silver halide photographic material which can give an image of high sensitivity, high contrast and high maximum density.

Another object of the present invention is to inhibit increase of fog or change in sensitivity and gradation which is extremely increased particularly during high temperature rapid processing, and also make the changes in sensitivity or gradation due to variance in temperature during high temperature processing smaller.

Briefly, the object of the present invention is to provide a light-sensitive silver halide emulsion capable of giving constantly stable photographic performances.

The above objects of the present invention can be accomplished by a light-sensitive silver halide photographic material having at least one silver halide emulsion layer on a support, characterized in that said light-sensitive photographic material contains light-sensitive silver halide grains, metal salt grains having internal fog and a polyhydric alcohol having at least two hydroxyl groups having a melting point of 40° C. or higher.

Further, the above objects can be accomplished by a high sensitivity light-sensitive silver halide photographic material comprising a surface latent image type silver halide emulsion and an internal fog type silver halide emulsion having fog nuclei internally of grains, characterized in that said light-sensitive silver halide photographic material contains a compound represented by the formula [I] shown below and said internal fog type silver halide emulsion is of the core/shell type emulsion prepared by simultaneous addition of an aqueous halide solution and an aqueous silver compound solution after fogging the surface of the silver halide core particles with the use of a reducing agent.

Formula [I]

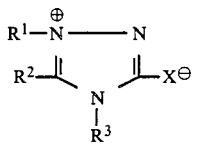

wherein X represents a sulfur atom or $=N-R^4$, each of $R^1$, $R^2$, $R^3$ and $R^4$ represents a hydrogen atom, a substituted or unsubstituted alkyl group, aryl group or heterocyclic group; with proviso that when $R^4$ is a hydrogen atom, $R^1$ to $R^3$ represent other groups than hydrogen atom, and also $R^1$ and $R^2$, $R^2$ and $R^3$, and $R^3$ and $R^4$ may be bonded together to form a ring.

DESCRIPTION OF THE PREFERRED EMBODIMENTS

The polydric alcohol having a melting point of 40° C. or higher and also having at least two hydroxyl groups in the molecule to be used in the present invention may be alcohols having 2 to 12 hydroxyl groups and 2 to 20 carbon atoms in the molecule, and also in which hydroxyl group and hydroxyl group are not conjugated with a conjugation chain, that is, the type oxidized cannot be written, preferably those having a melting point of 50° C. or higher and 300° C. or lower.

Specific examples are shown below by No. 1–50, but the present invention is not limited to these examples.

| No. | Compound name | m.p. (°C.) |
|---|---|---|
| 1. | 2,3,3,4-Tetramethyl-2,4-pentanediol | 76 |
| 2. | 2,2-Dimethyl-1,3-propanediol | 126–128 |
| 3. | 2,2-Dimethyl-1,3-pentanediol | 60–63 |
| 4. | 2,2,4-Trimethyl-1,3-pentanediol | 52 |
| 5. | 2,5-Hexanediol | 43–44 |
| 6. | 2,5-Dimethyl-2,5-hexanediol | 92–93 |
| 7. | 1,6-Hexanediol | 42 |
| 8. | 1,8-Octanediol | 60 |
| 9. | 1,9-Nonanediol | 45 |
| 10. | 1,10-Decanediol | 72–74 |
| 11. | 1,11-Undecanediol | 62–62.5 |
| 12. | 1,12-Dodecanediol | 79–79.5 |
| 13. | 1,13-Tridecanediol | 76.4–76.6 |
| 14. | 1,14-Tetradecanediol | 83–85 |
| 15. | 1,12-Octadecanediol | 66–67 |
| 16. | 1,18-Octadecanediol | 96–98 |
| 17. | Cis-2,5-dimethyl-3-hexene-2,5-diol | 69 |
| 18. | Trans-2,5-dimethyl-3-hexene-2,5-diol | 77 |
| 19. | 2-Butyne-1,4-diol | 55 |
| 20. | 2,5-Dimethyl-3-hexyne-2,5-diol | 95 |

-continued

| No. | Compound name | m.p. (°C.) |
|---|---|---|
| 21. | 2,4-Hexadiyne-1,6-diol | 111–112 |
| 22. | 2,6-Octadiyne-1,8-diol | 88.5–89.5 |
| 23. | 2-Methyl-2,3,4-butanetriol | 49 |
| 24. | 2,3,4-Hexatriol | about 47 |
| 25. | 2,4-Dimethyl-2,3,4-pentanetriol | 99 |
| 26. | 2,4-Dimethyl-2,3,4-hexanetriol | 75 |
| 27. | Pentamethyl glycerine | 116–117 |
| 28. | 2-Methyl-2-oxymethyl-1,3-propanediol | 119 |
| 29. | 2-Isopropyl-2-oxymethyl-1,3-propanediol | 83 |
| 30. | 2,2-Dihydroxymethyl-1-butanol | 53 |
| 31. | Erythritol | 126 |
| 32. | D-threitol | 88 |
| 33. | L-threitol | 88–89 |
| 34. | rac-threitol | 72 |
| 35. | Pentaerythritol | 260–265 |
| 36. | 1,2,3,4-Pentatetrol | 106 |
| 37. | 2,3,4,5-Hexanetetrol | 162 |
| 38. | 2,5-Dimethyl-2,3,4,5-hexanetetrol | 153–154 |
| 39. | 1,2,5,6-Hexanetetrol | 95 |
| 40. | 1,3,4,5-hexanetetrol | 88 |
| 41. | 1,6-(Erythro-3,4)-hexanetetrol | 121–122 |
| 42. | 3-Hexene-1,2,5,6-tetrol | 80–82 |
| 43. | 3-Hexyne-1,2,5,6-tetrol | 113–114.5 |
| 44. | Adnitol | 102 |
| 45. | D-arabitol | 102 |
| 46. | L-arabitol | 102 |
| 47. | Rac-arabitol | 105 |
| 48. | Xylitol | 93–94.5 |
| 49. | Mannitol | 164 |
| 50. | Dulcitol | 188.5–189 |

The amount of the above compounds No. 1–50 is not particularly limited, but may be 1 g to 100 g, preferably 5 to 50 g per 1 mole of silver halide. And, the above compounds No. 1–50 are added in the silver halide emulsion layer or a layer adjacent thereto. Preferably, they can be added in at least one or both of the light-sensitive silver halide emulsion and the metal salt emulsion having internally fog nuclei, or in a mixed system of the silver halide emulsion and the metal salt emulsion having internally fog nuclei. They can be added at any desired time, but during the period after completion of chemical sensitization to during coating. As the addition method, they can be directly dispersed into a hydrophilic colloid, or alternatively they may be dissolved in an organic solvent such as methanol or acetone before addition.

In the present invention, "light-sensitivity" means that the light-sensitive silver halide grains have higher sensitivity than that of the internally fogged metal salt grains. More specifically, it means that they have sensitivity of 10-fold or higher, more preferably 100-fold or higher of the sensitivity of the metal salt grains.

Sensitivity as herein mentioned may be defined similarly as the sensitivity shown below.

In a light-sensitive silver halide emulsion, a conventional silver halide emulsion such as the surface latent image type emulsion may be used.

Here, the surface latent image type silver halide emulsion refers to an emulsion which, when developed according to the surface development (A) and the method of the internal development (B) shown below after exposure for 1 to 1/100 sec., exhibits a sensitivity obtained by the surface development (A) which is greater than the sensitivity obtained by the internal development (B), preferably the former sensitivity being greater by 2-fold or higher than the latter. Here, sensitivity is defined as follows.

$$S=100/Eh$$

S shows sensitivity, Eh shows the exposure amount required for obtaining just the middle density ½ (Dmax+Dmin) between the maximum density (Dmax) and the minimum density (Dmin).

Surface Development (A)

In the developing solution of the following recipe, developing is carried out at 20° C. for 10 minutes.

| | |
|---|---|
| N—methyl-p-aminophenol (hemisulfate) | 2.5 g |
| L-Ascorbic acid | 10 g |
| Sodium metaborate tetrahydrate | 35 g |
| Potassium bromide | 1 g |
| Water added to | 1 liter |

Internal Development (B)

After processing in a bleaching solution containing 3 g/liter of potassium ferricyamide and 0.0126 g of phenosafranine and then washing with water for 10 minutes, development is carried out in the developing solution of the recipe shown below at 20° C. for 10 minutes.

| | |
|---|---|
| N—methyl-p-aminophenol (hemisulfate) | 2.5 g |
| Ascorbic acid | 10 g |
| Sodium metaborate tetrahydrate | 35 g |
| Potassium bromide | 1 g |
| Sodium thiosulfate | 3 g |
| Water added to | 1 liter |

As the surface latent image type silver halide, there may be specifically employed silver chloroiodide, silver iodobromide, silver chloride, silver chlorobromide, silver bromide and silver chloroiodobromide. Here, the content of silver iodide may be preferably 0.1 to 30 mol %, particularly within the range from 0.5 to 10 mol %. The mean grain size should preferably be greater than that of the metal salt grains having internally fog nuclei, particularly preferably 0.5 μm to 3 μm. The grain size distribution may be either narrow or broad. The silver halide grains in the emulsion may be those having regular crystal forms such as cubic, octahedral, tetradecahedral forms, or irregular crystal forms such as spherical, plate-like or potato-like forms or composite forms of these crystal forms. They may also comrise a mixture of grains with various crystal forms. Also, flat plate particles having a particle diameter which is 3-fold or more of the particle thickness may be preferably used for the present invention.

The photographic emulsion to be used in the present invention can be prepared by use of the methods as described in Chimie et Physique Photographique, written by P. Glafkides (published by Paul Montel Co., 1967), Photographic Emulsion Chemistry, written by G. F. Duffin (published by The Focal Press, 1966), Making and Coating Photographic Emulsion, written by V. L. Zelikman et al (published by The Focal Press, 1964), etc. That is, either one of the acidic method, the neutral method, the ammonia method, etc., may be available, and as the system for reacting a soluble silver salt with a soluble halide salt, there may be employed any of the one side mixing method, the simultaneous mixing method or a combination of them, etc.

It is also possible to use the method in which grains are formed under excessive silver ions (the so-called reverse mixing method). As one form of the simultaneous mixing method, it is also possible to use the method in which pAg in the liquid phase in which silver halide is formed is maintained constant, namely the so-called controlled double jet method.

According to this method, a silver halide emulsion having regular crystal forms and approximately uniform grain size can be obtained.

Two or more kinds of silver halide emulsions formed separately may be mixed and used.

In the process of formation or physical ripening of silver halide grains, cadmium salts, zinc salts, lead salts, thallium salts, iridium salts, or complex salts thereof, rhodium salts or complex salts thereof, iron salts or iron complex salts, etc., may be also permitted to coexist.

The emulsion to be used in the present invention is usually removed of soluble salts after formation of precipitates or after physical ripening, and as the means for that purpose, there may be employed the washing method with the use of gelled gelatin which has been known from old time, or alternatively there may be also used the sedimentation method (flocculation) utilizing inorganic salts comprising polyvalent anions such as sodium sulfate, anionic surfactants, anionic polymers (e.g. polystyrene sulfonic acid), or gelatin derivatives (e.g. aliphatic acylated gelatin, aromatic acylated gelatin, aromatic carbamoylated gelatin, etc.). Also, the process for removing soluble salts may be omitted.

Although the light-sensitive silver halide emulsion may be used as the so-called primitive emulsion without chemical sensitization, but it is usually chemically sensitized. For chemical sensitization, there may be employed the methods as described in the books of Glafkides or Zelikman supra or Die Grundlagen der Photographischen Prozesse mit Silberhalogeniden, edited by H. Frieser (Akademische Verlagsgesellschaft, 1968).

More specifically, there may be employed the sulfur sensitization method in which a compound containing sulfur reactive with silver ions or activated gelatin is used, the reduction sensitization method in which a reductive substance is used, the noble metal senstization method in which gold or other novel metal compound is used, etc., may be used alone or as a combination. As the sulfur sensitizing agent, there may be employed thiosulfates, thioureas, thiazoles, Rhodamins and other compounds, and specific examples thereof are disclosed in U.S. Pats. Nos. 1,574,944, 2,410,689, 2,278,947, 2,728,668 and 3,656,955. As the reduction sensitizer, there may be employed stannous salts, amines, hydrazine derivatives, formamidinesulfinic acid, silane compounds, etc., and specific examples thereof are disclosed in U.S. Pats. Nos. 2,487,850, 2,419,974, 2,518,698, 2,983,609, 2,983,610 and 2,694,637. For noble metal sensitization, other than gold complex, complex salts of metals of the group VIII of the periodic table such as platinum, iridium, palladium, etc., can be used, and specific examples thereof are disclosed in U.S. Pats. Nos. 2,399,083 and 2,448,060, U.K. Pat. No. 618,061, etc.

Next, as the metal salt grains having internally fog nuclei to be used in the light-sensitive silver halide photographic material of the present invention, there may be included light-sensitive cuprous halide grains or thallium (I) compounds (e.g. TlBr, TlI, etc.) as disclosed in Japanese Provisional Patent Publications No. 138633/1982, No. 140317/1982 and No. 154233/1982, but silver halide grains are preferred.

Also, the metal salt grains having internally fog nuclei as mentioned above may be stabilized by use of a compound having mercapto functional groups.

Examples of the compounds having mercapto functional groups may include heterocyclic nitrogen compounds having mercapto functional groups with said mercapto groups being bonded to the carbon atom at the α-position relative to the nitrogen atom of the heterocyclic ring, tetrazaindenes having at least one mercapto functional group, purines having at least one mercapto functional group, triazaindenes having at least one mercapto functional group, pentazaindenes having at least one mercapto functional group, etc.

In the light-sensitive silver halide photographic material of the present invention, by use of an internally fogged metal salt emulsion together with a light-sensitive silver iodobromide emulsion of high iodine content, higher sensitization, hardening of tone, increase of covering power, etc., may be effected.

Here, it is preferred that the sensitivity of the internally fogged metal salt emulsion should be lower than that of the light-sensitive silver halide emulsion. More specifically, the internally fogged metal salt emulsion should preferably have a sensitivity lower by 10-fold or more, more preferably by 100-fold or more (relative to the light-sensitive silver halide emulsion).

For example, as the silver halide emulsion having internally fog nuclei to be used in the light-sensitive silver halide photographic material of the present invention, there may be employed an emulsion which gives a transmitted fog density of 0.5 or less (the density of the support itself is excluded) when a test strip coated on a transparent support with the emulsion to a silver quantity of 2 g/m$^2$ is developed without exposure with D-19 (developing solution instructed by Eastman Kodak Co.) at 35° C. for 2 minutes, and gives a transmitted fog density of 1.0 or more (the density of the support itself is excluded) when the same test strip is developed without exposure with a developing solution in which 0.5 g/liter of potassium iodide is added in D-19 at 35° C. for 2 minutes.

The silver halide emulsion having internally fog nuclei can be produced according to various methods. As the fogging method, there are the method in which light or X-ray is irradiated, the method in which fog nuclei are chemically prepared by a reducing agent, a metal compound or a sulfur containing compound and the method in which emulsion is prepared under the conditions of low pAg and high pH. For preparing fog nuclei only internally, there may be employed the method in which the silver halide grains are fogged both internally and on the surface according to the above methods and thereafter the fog nuclei on the surface are bleached with a potassium ferricyamide solution, etc. More preferably, however, a core emulsion having fog nuclei should be prepared according to the method under the conditions of low pAg and high pH or the chemical fogging method, and then a shell emulsion covered around the core emulsion. For this core-shell emulsion preparation method, reference can be made to, for example, the description in U.S. Pat. No. 3,206,313.

In the present invention, the method for fogging the core emulsion may be the method by use of a reducing agent and it is also preferable to use a reducing agent and a gold compound in combination. That is, the present inventors have found that the object of the present invention can be accomplished by fogging by use of a reducing agent and containing a compound represented by the above formula [I]. As the method for fogging the core emulsion, there have been also known the method in which light is irradiated, the method in which chemical fogging is effected by use of an unstable sulfur compound or the method in which ripening is effected at low pAg and high pH, but at least one object of the present invention cannot be accomplished by use of these methods and also combined with the compound represented by the above formula [I].

As the reducing agent to be used in the present invention. There may be employed stannous chloride, aldehyde compounds, hydrazine type compounds, amine borane, thiourea dioxide, etc. For imparting sufficiently active fog nuclei and making fog of the emulsion after shelling low and further making the increase of fog when the above light-sensitive photographic material is stored under highly humid and high temperature condition smaller, it is preferable to use thiourea dioxide.

Also, for giving fog to the core emulsion by use of a reducing agent, pH may be lower than 6.5, but a range from pH 6.5 to 10.0 is preferred. In the case of pH lower than 6.5, ripening at a high temperature and for long time is required. On the other hand, in the case of pH exceeding pH 10.0, hydrolysis of gelatin will occur during ripening, whereby the coated film properties as the light-sensitive material are deteriorated.

The amount of the reducing agent used may be preferably $1\times10^{-4}$ mmole to 5 mmole per 1 mole of silver halide which becomes the core, more preferably $5\times10^{4}$ mmole to 1 mmole.

Further, the method of using a reducing agent and a gold complex is effective for imparting active fog nuclei, and as the gold complex, there may be employed, for example, chloroauric acid, thiocyanoauric acid, sodium chloroaurate, potassium chloroaurate, potassium bromoaurate, potassium cyanoaurate, potassium iodoaurate, etc. The amount of the gold complex may be preferably in the range from 0.0005 mmole to 0.5 mmole per 1 mole of the silver halide which becomes the core, more preferably from 0.001 to 0.1 mmole.

Next, the formula [I] is to be described.

In the formula [I], the substituted or unsubstituted alkyl group represents a substituted or unsubstituted straight chain alkyl group (methyl, ethyl, n-octyl, etc.), a substituted or unsubstituted branched alkyl group (isopropyl, isobutyl, 2-ethylhexyl, t-butyl, etc.), a substituted or unsubstituted cycloalkyl group (cyclopropyl, cyclopentyl, cyclohexyl, etc.), and the substituted or unsubstituted aryl group represents a substituted or unsubstituted phenyl group, naphthyl group, etc. The substituted or unsubstituted hetero ring represents a substituted or unsubstituted 3-pyridyl group, 3-furyl group, 3-benzothiazolyl group, etc.

Here, as the substituent on $R^1$, $R^2$, $R^3$ and $R^4$, there may be included halogen atoms, nitro group, cyano group, alkoxy group, carbamoyl group, sulfamoyl group, carboxy group, alkoxycarbonyl group, sulfo group, amide group, sulfoneamide group, hydroxy group, sulfonyl group, sulfinyl group, sulfenyl group, mercapto group, amino group, ureido group, aminocarboxy group, alkoxycarbonylamino group, aryl group, hetero ring, and they may have at least one of these substituents.

Further, $R^1$ and $R^2$, $R^2$ and $R^3$ and $R^3$ and $R^4$ may be also bonded together to form a ring (e.g. a 5-membered ring, 6-membered ring).

In the following, specific examples of meso-ionic triazolium compounds represented by the formula [I] to be used in the present invention are shown, but the compounds which can be used in the present invention are not limited to these examples.

I-1

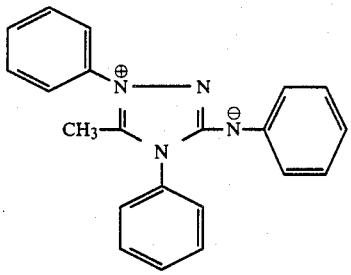

I-2

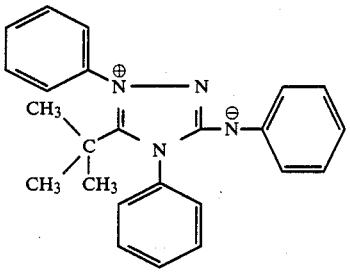

I-3

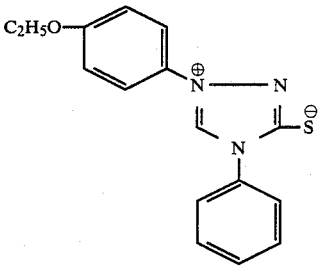

I-4

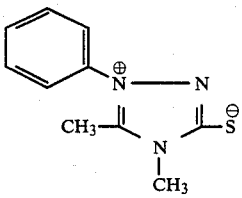

I-5

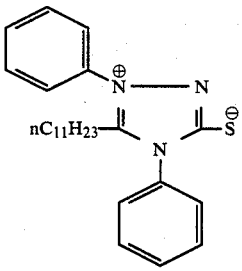

I-6

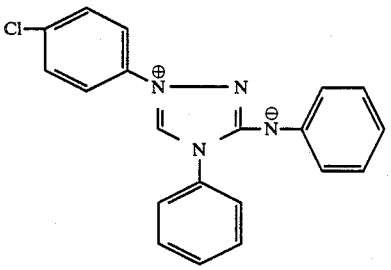

-continued

I-7

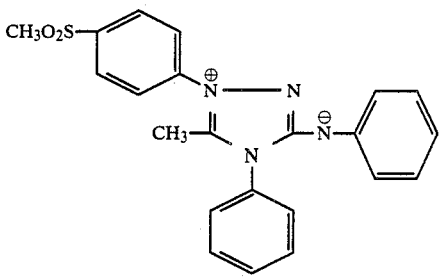

I-8

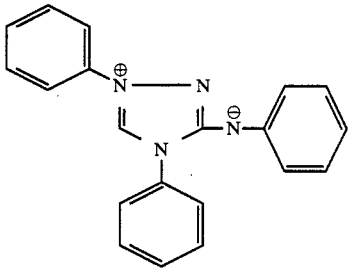

I-9

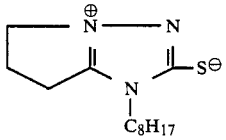

I-10

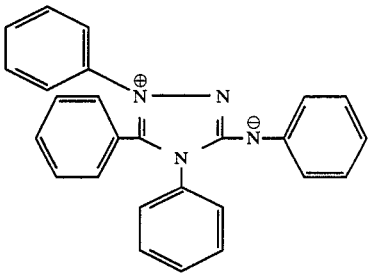

I-11

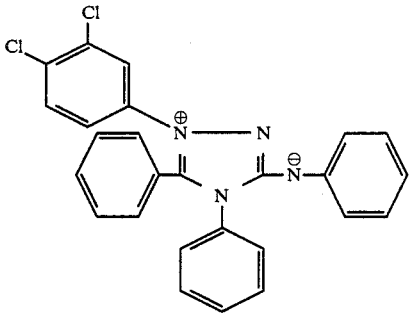

Otherwise, the compounds disclosed in Japanese Provisional Patent Publications No. 87322/1985, No. 117240/1985 and No. 122936/1985 can be also similarly used.

The meso-ionic triazolium compound represented by the formula [I] can be synthesized easily by the methods as disclosed in Japanese Provisional Patent Publications No. 87322/1985, No. 117240/1985 and No. 122936/1985.

The compound represented by the formula [I] of the present invention may be added preferably in the light-sensitive emulsion layer of the light-sensitive photographic material, but may be also added in other non-light-sensitive layers. For adding these compounds in these layers, these compounds may be added either as such or after dissolved in water or an organic solvent or a solvent mixture of water with an organic solvent, or as an acidic solution of the compound represented by the formula [I] into the coating solution for forming the layer, followed by coating of said coating solution and drying.

Also, when added in the emulsion layer, it may be added during the preparation step of emulsion (e.g. chemical ripening step, etc.) or after completion of the step. Particularly, it is preferable to add the compound after preparation of emulsion, immediately before coating.

The amount of the compound represented by the formula [I] of the present invention may differ depending on the kind of the light-sensitive silver halide emulsion in the light-sensitive photographic material used, but may be generally preferably $5\times10^{-6}$ to $5\times10^{-2}$ mole per 1 mole of silver, particularly preferably $5\times10^{-5}$ to $5\times10^{-3}$ mole.

As the silver halide emulsion which becomes the core, any of silver chloride, silver chlorobromide, silver bromide, silver iodobromide and silver chloroiodobromide may be employed, but it may preferably comprise 5 to 100 mole % of silver chloride, 0 to 95 mole % of silver bromide and 0 to 5 mole % of silver iodide.

Also, as the silver halide emulsion which becomes the shell, any of silver chloride, silver chlorobromide, silver chloroiodobromide, silver bromide and silver iodobromide may be employed.

The silver halide emulsion having internally fog nuclei should preferably have a silver halide grain size (mean grain size) of 0.1 to 0.7 μm and a thickness of the shell portion preferably of 0.01 to 0.3 μm.

The mean particle size of the surface latent image type silver halide emulsion should preferably be 0.5 to 3 μm, and the silver halide existing in this emulsion is silver iodobromide or silver chloroiodobromide.

The metal salt emulsion having internally fog nuclei has a mean grain size smaller than the silver halide emulsion, having preferably a mean grain size of 1.0 to 0.05 μm, more preferably a mean grain size of 0.6 to 0.1 μm, particularly 0.5 μm or less to give good results.

The mean particle size of the silver halide emulsion may be measured by direct measurement from an electron microscope photograph, by use of Coulter counter, or a centrifugal system particle size distribution measuring instrument based on the principle of liquid phase sedimation method, etc.

For example, when AgBrI is used as the silver halide grains of the surface latent image type silver halide emulsion, the AgI distribution internally of the grains may be uniform, or concentrated higher toward the inner portion to be localized internally. When AgI is localized internally of the grains, the internal portion refers to the range from the grain center to the portion of the grain which covers $\frac{2}{3}$ of the total silver quantity contained in the grain.

Further, the surface latent image type silver halide emulsion may be a mono-dispersed emulsion. Here, the mono-dispersed emulsion refers to one satisfying the following relationship $$\sigma/r \leqq 0.20,$$

wherein r represents the mean grain size of silver halide grains and $\sigma$ its standard deviation.

In the present specification, the mean grain size is represented by the mean value based on the diameters in the case of spherical silver halide grains, or diameter calculated as the circular image with the same area of the projected image in the case of grains with shapes other than spheres.

As the method for producing a mono-dispersed emulsion, there may be employed, for example, the method as disclosed in Japanese Patent Application No. 246704/1985.

The silver halide emulsion having internally fog and the surface latent image type silver halide emulsion may be mixed with each other and then coated in the surface layer, or alternatively the silver halide emulsion having internally fog may be made nearer to the support than the surface latent image type silver halide emulsion, and these emulsions may be coated in separate layers.

The content ratio of the light-sensitive silver halide grains to the internally fogged metal salt grains in the light-sensitive silver halide photographic material of the present invention can be varied depending on the type of the emulsion employed (e.g. halogen composition), the kind of the light-sensitive material used, the use or the contast of the emulsion employed, etc., but it is preferably 100:1 to 1:100, particularly preferably 10:1 to 1:10. Also, the amount of silver coated should be preferably 0.5 to 10 g/m$^2$ as the total amount.

In the light-sensitive silver halide photographic material of the present invention, various kinds of hydrophilic colloids can be used as the binder.

The colloid to be used for this purpose may include hydrophilic colloids generally used in the field of photography, such as gelatin, colloidal albumin, polysaccharides, cellulose derivatives, synthetic resins such as polyvinyl compounds including polyvinyl alcohol derivatives, acrylamide polymers, etc. Together with the hydrophilic colloid, it is also possible to incorporate a hydrophilic colloid such as dispersed polymerized vinyl compounds, particularly those which can increase dimensional stability of the light-sensitive silver halide photographic material. Examples of suitable compounds of this kind may include alkyl (meth)acrylate, alkoxyalkyl (meth)acrylate, glycidyl (meth)acrylate, (meth)acrylamide, vinyl ester (e.g. vinyl acetate), acrylonitrile, olefin, styrene, etc., either alone or a combination or thereof, or polymers comprising combinations of these with acrylic acid, methacrylic acid, α,β-unsaturated dicarboxy acid, hydroxyalkyl (meth)acrylate, sulfoalkyl (meth)acrylate, styrene sulfonic acid, etc., as the monomeric components.

In the above photographic emulsion, various compounds can be added for prevention of desensitization or increase of fog in the preparation steps, during storage or during processing of the light-sensitive silver halide photographic material. That is, it is possible to add a large number of compounds known as stabilizers, including thiazoles such as benzothiazolium salts, nitroindazoles, triazoles, benzotriazoles, benzimidazoles (particularly nitro- or halo-substituted compounds), heterocyclic mercapto compounds such as mercaptothiazoles, mercaptobenzothiazoles, mercaptobenzimidazoles, mercaptothiadiazoles mercaptotetrazoles (particularly 1-phenyl-5-mercaptotetrazole), mercaptopyridines; the above heterocyclic mercapto compounds having water-soluble groups such as carboxyl group or sulfone group; thioketo compounds such as oxazolinethione; azaindenes such as tetraazaindenes (particularly 4-hydroxy-substituted-(1,3,3a,7)-tetraazaindenes), benzene thiosulfonic acids, benzene sulfinic acids, etc.

Examples of useful compounds are described by referring to original literatures in The Theory of The Photographic Process, third edition, written by K. Mees 1966.

As to further detailed Examples and the methods of use thereof, reference can be made to, for example, U.S. Pats. Nos. 3,954,474, 3,982,947 and 4,021,248 or Japanese Patent Publication No. 28660/1977.

The surface latent image type silver halide emulsion can be chemically sensitized according to the known method. Chemical sensitization may include sulfur sensitization by use of a thiosulfate, allylthiocarbamide, thiourea, allylisothiacyanate, cystine, p-toluenethiosulfonate, rhodanine, a mercapto compound, etc., and also gold sensitization by use of a chloroaurate, potassium chloroaurate, auric trichloride, potassium auric thiocyanate, potassium iodoaurate, tetracyanoauric acid, etc., and these may be used in combination.

The amount of the sulfur sensitizing agent added may vary within a considerable range depending on various conditions, but it is generally about $1\times10^{-7}$ to $1\times10^{-2}$ mole per 1 mole of silver. The amount of the silver sensitizing agent added may also vary within a considerable range depending on various conditions, but it is generally about $1\times10^{-9}$ to $1\times10^{-2}$ mole per 1 mole of silver.

Also, in sulfur-gold sensitization, the formulation ratio of both may vary depending on the ripening condition, etc., but generally about 1 to 1000 moles of a sulfur sensitizing agent are employed per 1 mole of gold sensitizing agent. Also, the gold sensitizing agent may be added simultaneously with the sulfur sensitizing agent, during sulfur sensitization or after completion of sulfur sensitization.

These chemical sensitizing agents may be added as an aqueous solution of water-soluble compounds, or as a solution of an organic solvent readily miscible with water such as methanol, ethanol, etc., of compounds soluble in an organic solvent.

The conditions such as pH, pAg, temperature, etc., during chemical sensitization are not particularly limited, but a pH value of 4 to 9, particularly 5 to 8 is preferred, and a pAg value is preferably maintained at 5 to 11, particularly 8 to 10. On the other hand, the temperature may be preferably 40° to 90° C., particularly 45° to 75° C.

The silver iodide distribution within the silver halide grains is determined according to the method in which ion etching and X-ray photoelectric spectrometry are combined.

Also, grains in which the silver iodide distribution within the grains is uniform or more enriched in the internal portion than the surface can be prepared according to various methods.

Concerning the layer constitution of the light-sensitive silver halide photographic material according to the present invention, some embodiments may be considered. Typical examples are shown below as (1)–(5).

(1) Constitution having light-sensitive silver halide grains, metal salt grains having internally fog nuclei and a polyhydroric alcohol having a melting point of 40° C. or higher in the at least two hydroxyl groups and molecule (hereinafter called merely polyhydric alcohol) contained in the same coating composition (emulsion), which composition is coated on a support;

(2) constitution having first an emulsion layer containing metal salt grains having internally fog nuclei coated on a support and providing further an emulsion layer containing light-sensitive silver halide grains and a polyhydric alcohol coated thereon;

(3) constitution having first light-sensitive silver halide grains and metal salts grains having internally fog nuclei contained in the same coating composition (emulsion), coating said composition on a support, and providing further an emulsion layer containing light-sensitive silver halide grains coated thereon;

(4) constitution having light-sensitive silver halide grains, metal salt grains having internally fog nuclei and a polyhydric alcohol contained in the same coating composition (emulsion), coating said composition on a support and providing further an emulsion containing light-sensitive silver halide grains and metal salt grains having internally fog nuclei with a composition different from the lower layer coated thereon;

(5) constitution having a gelatin coating layer containing a polyhydric alcohol coated on the constitution of the above (1)–(4) from which only the polyhydric alcohol is removed, etc.

In the photographic emulsion layer of the light-senitive photographic material of the present invention, for the purpose of enhancing sensitivity or contrast, or promoting development, there may be contained, for example, polyalkylene oxide or derivatives thereof such as ether, ester, amine, etc., thioether compounds, thiomorpholine compounds, quaternary ammonium salt compounds, urethane derivatives, urea derivatives, imidazole derivatives, 2-pyrazolidones, etc.

In the light-sensitive silver halide photographic material of the present invention, the silver halide emulsion layer and other hydrophilic colloid layers, can be hardened with any suitable hardening agent. These hardening agents may include aldehyde type compounds such as mucochloric acid, mucobromic acid, mucophenoxychloric acid, mucophenoxybromic acid, formaldehyde, dimethylolurea, trimethylolmelamine, glyoxal, monomethylglyoxal, 2,3-dihydroxy-1,4-dioxane, succinealdehyde, 2,5-dimethoxytetrahydrofuran, glutaraldehyde, etc.; active vinyl type compounds such as divinylsulfone, methylene bismaleimide, 5-acetyl-1,3-diacryloylhexahydro-s-triazine, 1,3,5-triacryloyl-hexahydro-s-triazine, 1,3,5-trivinylsulfonylhexahydro-s-triazinebis (vinylsulfonylmethyl)ether, 1,3-bis (vinylsulfonylmethyl)propanol-2, bis(α-vinylsulfonylacetamido)ethane, etc.; active halogenic compounds such as 2,4-dichloro-6-hydroxy-s-triazine sodium salt, 2,4-dichloro-6-methoxy-s-triazine, 2,4-dichloro-6-(4-sulfoanilino)-s-triazine sodium salt, 4-dichloro-6-(2-sulfoethylamino)-s-triadine, N,N'-bis(2-chloroethylcarbamyl)-piperazine, etc.; epoxy compounds such as bis(2,3-epoxypropyl)methylpropylammonium, p-toluenesulfonic acid salt, 1,4-bis(2',3'-epoxypropyloxy)butane, 1,3,5-triglycidyl isocyanurate, 1,3-diglycidyl-5-(α-acetoxy-β-oxypropyl) isocyanurate, etc.; ethyleneimine type compound such as 2,4,6-triethyleneimino-s-triazine, 1,6-hexamethylene-N,N'-bisethyleneurea, bis-β-ethyleneiminoethyl thioether, etc.; methane sulfonic acid ester compounds such as 1,2-di(methanesulfoneoxy)ethane, 1,4-(methanesulfoneoxy)butane, 1,5-di(methanesulfoneoxy)pentane, etc.; and further carbodiimide type compounds, isooxazole type compounds and inorganic compounds such as chromium alum; and so on.

In the photographic emulsion layer or other constituent layers in the light-sensitive silver halide photographic material of the present invention, there may be also contained other surfactants for various purposes such as coating aids, antistatic, improvement of sliding property, emulsification, prevention of adhesion and improvement of photographic characteristics (e.g. development promotion, tone hardening, sensitization), etc.

For example, there may be employed nonionic surfactants such as saponin (steroid type), alkylene oxide derivatives (e.g. polyethyleneglycol, polyethyleneglycol/polypropyleneglycol condensate, polyethyleneglycolalkylene ethers or polyethyleneglycolalkylaryl ethers, polyethyleneglycol esters, polyethyleneglycolsorbitane esters, polyalkyleneglycolalkylamide or amides, polyethylene oxide adducts of silicone), glycidole derivatives (e.g. alkenylsuccinic acid polyglyceride, alkylphenolpolyglyceride), fatty acid esters of polyhydric alcohols, alkyl esters of sugar, etc.; anionic surfactants containing carboxy group, sulfo group, phospho group, sulfate ester group, phosphate ester group, etc., such as alkylcarboxylate, alkylsulfonate, alkylbenzenesulfonate, alkylnaphthalene sulfonate, alkyl sulfate esters, alkylphosphate esters, N-acyl-N-alkyltauric acid sulfosuccinic acid esters, sulfoalkylpolyoxyethylenealkylphenyl ethers, polyoxyethylenealkylphosphate esters, etc.; amphoteric surfactants such as amino acids, aminoalkylsulfonic acids, aminoalkylsulfate or phosphate esters, alkylbetaines, amine oxides, etc.; cationic surfactants such as alkylamine salts, aliphatic or aromatic quaternary ammonium salts, heterocyclic quaternary ammonium salts such as of pyridinium, imidazolium, etc., and aliphatic or heterocyclic-containing phosphonium or sulfonium salts, etc.

In the light-sensitive silver halide photographic material of the present invention, there may be contained water-soluble dyes in the hydrophilic colloid layer as the filter dye or for other various purposes such as irradiation prevention, halation prevention, etc. As such dyes, oxonol dyes, hemioxonol dyes, styryl dyes, melocyanine dyes cyanine dyes and azo dyes may be included. Among them, oxonol dyes, hemioxonol dyes and melocyanine dyes are useful.

In the light-sensitive silver halide photographic material of the present invention, when dyes or UV-ray absorbers are included in the hydrophilic colloid layer, they may be mordanted with a cationic polymer, etc.

Also, the light-sensitive silver halide photographic material of the present invention can also contain an alkyl acrylate type latex as disclosed in U.S. Pats. Nos. 3,411,911 and 3,411,912, Japanese Patent Publication No. 5331/1970, etc., in the photographic constituent layer.

In the silver halide emulsion, other additives, particularly those useful for photographic emulsion, such as lubricants, sensitizers, light absorbing dye, etc., can be also added.

In the light-sensitive silver halide photographic material of the present invention, the photographic emulsion may be spectrally sensitized to blue light, green light, red light or infrared light or relatively longer wavelength. The dyes to be used may include cyanine dyes, melocyanine dyes, complex cyanine dyes, complex melocyanine dyes, holobolar cyanine dyes, hemicyanine dyes, styryl dyes and hemioxonol type. Particularly useful dyes are dyes belong to cyanine dyes, melocyanine dyes and complex melocyanine dyes. For these dyes, any of the nuclei conventionally utilized for cyanine dyes as the basic heterocyclic nucleus can be applied. That is, there can be applied pyrroline nucleus, oxazoline nucleus, thiazoline nucleus, pyrrol nucleus, oxazole nucleus, thiazole nucleus, selenazole nucleus, imidazole nucleus, tetrazole nucleus, pyridine nucleus, etc., nuclei of these nuclei to which alicyclic hydrocarbon rings are fused and nuclei of these nuclei to which aromatic hydrocarbon rings are fused, namely indolenine nucleus, benz indolenine nucleus, indole nucleus, benzoxazole nucleus, naphthooxazole nucleus, benzothiazole nucleus, naphthothiazole nucleus, benzoselenazole nucleus, benzimidazole nucleus, quinoline nuleus, etc. These nuclei may be substituted on the carbon atoms.

For melocyanine dyes or complex melocyanine dyes, as the nuleus having a ketomethylene structure, a 5- to 6-membered heterocyclic nuleus such as pyrazoline-5-one nucleus, thiohidantoin nucleus, 2-thiooxazolidine-2,4-dione nuleus, thiazolidine-2,4-dione nucleus, rhodanine nucleus, thiobarbituric acid nucleus, etc., can be applied.

The sensitizing dye to be used invention may be used at a concentration equal to that used conventionally in a nega-type silver halide emulsion. Particularly, it is advantageously used at a dye concentration of the extent which does not substantially lower the inherent sensitivity of the silver halide emulsion. It may be preferably used at a concentration of the sensitizing dye of about $1.0\times10^{-5}$ to about $5\times10^{-4}$ mole, particularly about $4\times10^{-5}$ to $2\times10^{-4}$ mole per 1 mole of the silver halide.

The silver halide emulsion of the present invention may also contain a color image forming coupler, namely a compound which forms a dye through the reaction with the oxidized product of an aromatic amine (generally primary amine) developing agent (hereinafter abbreviated as coupler). The coupler should be desirably non-diffusive, having a hydrophilic group called balast group in the molecule. The coupler may be either tetravalent or divalent relative to silver ions. There may be also contained a colored coupler having the effect of color correction or a coupler releasing a developing inhibiting agent with development (so-called DIR coupler). The coupler may be also one which produces a colorlss product of the coupling reaction.

As the yellow color forming coupler, various closed chain ketomethylene type couplers can be used. Among them, benzoylacetoanilide type and pivaloyl acetanilide type compounds are advantageous.

As the magenta coupler, pyrazolone compounds, indazolone type compounds, cyanoacetyl compounds, etc., can be used, and particularly pyrazolone type compounds are advantageous.

As the cyan coupler, phenol type compounds, naphthol type compounds, etc., can be used.

Two or more kinds of the above couplers may be contained in the same layer, or alternatively the same compound may be contained in at least two layers. For incorporation of a coupler in the silver halide emulsion layer, it can be practiced according to the method as desclosed in U.S. Pat. No. 2,322,027, etc.

The protective layer in the light-sensitive silver halide photographic material of the present invention is a layer comprising hydrophilic colloid, and those as mentioned above can be used as the hydrophilic colloid to be used. Also, the protective layer may be either a single layer or multiple layers. In the protective layer, an antistatic agent may be contained.

In the emulsion layer or the protective layer of the light-sensitive silver halide photographic material of the present invention, preferably in the protective layer, a matting agent and/or a lubricating agent, etc., may be added. Preferable examples of the matting agent may include organic compounds such as water dispersible vinyl polymers such as polymethyl methacrylate with appropriate grain sizes (preferably having grain sizes of 0.3 to 5 μm, or 2-fold or more, particularly 4-fold or more of the thickness of the protective layer) or inorganic compounds such as silver halide, strontium barium sulfate, etc. The lubricating agent serves to prevent adhesion trouble similarly as the matting agent, and also is effective for improvement of frictional characteristic related to compatibility with camera during photographing of the film for movies or during projection, and typical examples may include preferably fluid paraffins, waxes such as higher fatty acid esters, polyfluorohydrocarbons or derivatives thereof, silicones such as polyalkylpolysiloxane, polyarylpolysiloxane, polyalkylarylpolysiloxane or alkylene oxide adduct derivatives thereof, etc.

In the light-sensitive silver halide photographic material of the present invention, otherwise, if necessary, an antihalation layer, an intermediate layer, a filter layer, etc. may be provideed.

In the light-sensitive silver halide photographic material of the present invention, other various additives can be added as desired. For example, dyes, development accelerators, optical brightening agents, color fog preventives, UV-ray absorbers, etc., may be employed. Specifically, those as described in Research Disclosure vol. 176, pp. 28–30 (RD - 17643, 1978) may be used.

Further, in the present invention, a compound releasing iodine ions (e.g. potassium iodide, etc.) can be contained in the silver halide emulsion, and a desired iamge can be obtained by use of a developing solution containing iodine ions.

In the light-sensitive silver halide photographic material of the present invention, the emulsion layer and other layers are coated on one surface or both surfaces of a flexible support conventionally used for a light-sensitive photographic materials. Useful materials as the flexible support may include films comprising semi-synthetic or synthetic polymers such as cellulose nitrate, cellulose acetate, cellulose acetate butyrate, polystyrene, polyvinyl chloride, polyethylene terephthalate, polycarbonate, etc., papers coated or laminated with a baryta layer or an α-olefin polymer (e.g. polyethylene, polypropylene, ethylene/butene copolymer), etc. The support may be colored with the use of a dye or a pigment. For the purpose of shielding light, it may be colored in black. The surface of these supports is generally subjected to subbing treatment for improvement of adhesion to the emulsion layer, etc. The subbing treatment may be preferably the treatments as disclosed in Japanese Provisional Patent Publications No. 104913/1977, No. 18949/1984, No. 19940/1984 and No. 19941/1984.

The support surface may be also applied with corona discharging, UV-ray irradiation, flame treatment, etc., before or after the subbing treatment.

In the light-sensitive silver halide photographic material of the present invention, the photographic emulsion layer and other hydrophilic colloid layers can be coated on the supports or on other layers according to various coating method. For coating, it is possible to use the dip coating method, the roller coating method, the curtain coating method, the extrusion coating method, etc.

The present invention can be used for any light-sensitive photographic material which requires high sensitivity or high contrast. For example, it can be used for X-ray light-sensitive photographic material, lith type light-sensitive photographic material, black-and-white nega light-sensitive photographic material, color nega light-sensitive photographic material, color paper light-sensitive material, etc.

Also, it can be utilized for a diffusion transfer light-sensitive material, color diffusion transfer light-sensitive material, etc., in which a posi image is made by dissolving undeveloped silver halide and precipitating the silver halide onto an image receiving layer approximate to the silver halide emulsion layer.

For photographic processing of the light-sensitive silver halide material of the present invention, various methods and various processing solutions as disclosed in Research Disclosure vol. 176, pp. 28–30 (RD - 17643) can be all applied. The photographic processing may be either the photographic processing for formation of a recorded image (black-and-white photographic processing) or the photographic processing for formation of a dye image (color photographic processing) depending on the purpose. The processing temperature is generally selected between 18° C. and 50° C., but a temperature lower than 18° C. or exceeding 50° C. may be also employed.

For example, the developing solution to be used in the case of black-and-white photographic processing can contain a known developing agent. As the developing agent, there may be employed dihydroxybenzenes (e.g. hydroquinone), 3-pyrazolidones (e.g. 1-phenyl-3-pyrazolidone), aminophenols (e.g. N-methyl-o-aminophenol), etc., either singly or as a combination. For photographic processing of the light-sensitive silver halide material of the present invention, a developing solution containing an imidazole can be also used as the solvent for silver halide as described in Japanese Provisional Patent Publication No. 78535/1982. Also, it is possible to carry out processing with the use of a developing solution containing the solvent for silver halide as described in Japanese Provisional Patent Publication No. 37643/1983 and an additive such as indazole or triazole. The developing solution may also contain dissolving aids, image toners, development accelerators, surfactants, deforming agents, hard water softeners, film hardening agents, viscosity imparting agents, etc., if necessary.

The pH of the developing solution may be preferably 9 to 11, particularly 9.5 to 10.5.

According to a preferred embodiment, the light-sensitive silver halide photographic material of the present invention is processed with a processing solution containing a dialkylaldehyde type film hardening agent (e.g. glutaraldehyde, β-methylglutaraldehyde, succinic dialdehyde, etc.) (e.g. developing bath, its preceeding bath, etc., added in an amount of about 1 to 20 g per 1 liter). The photographic emulsion according to the present invention becomes smaller in processing dependency in the processing as described above. Also, it can be processed by a roller automatic developing machine.

For the photographic emulsion of the present invention, the so-called "lith type" developing processing can be applied. The "lith type" developing processing refers to the developing processing in which developing process is carried out by propargation by use of a conventional dihydroxybenzene as the developing agent under a low sulfite ion concentration for photographic reproduction of line image or photographic reproduction of half tone image with dots (details are described in "Photographic Processing Chemistry" written by Mason, pp. 163–165, 1966).

As a special form of developing processing, there may be employed the method in which the developing agent is contained in the light-sensitive material, for example, in the emulsion layer, and the light-sensitive material is processed in an aqueous alkali solution to effect development. Of the developing agents, hydrophobic ones can be contained in the emulsion layer according to various methods described in Research Disclosure Vol. 169 (RD - 16928), U.S. Pat. No. 2,739,890, U.K. Pat. No. 813,253 or West Germany Pat. No. 1,547,763, etc. Such developing processing may be combined with silver salts stabilizing processing with a thiocyanate salt.

As the fixing solution, those having compositions generally used can be employed. As the fixing agent, in addition to thiosulfate salts, thiocyanate salts, organic sulfur compounds known to have the effect as the fixing agent can be used. The fixing solution may contain a water-soluble aluminum salt as the film hardening agent.

In the case of carrying out color photographic developing processing, for example, the nega-posi method, the color reversal method, the silver dye bleaching method, etc., may be employed.

The color developing solution comprises generally an aqueous alkaline solution containing a color developing agent. For the color developing agent, there may be employed primary aromatic amine developing agents, such as phenylenediamines (e.g. 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamideethylaniline, 4-amino-3-methyl-N-ethyl-N-β-methoxyethylaniline, etc.) or those as described in Photographic Processing Chemistry, written by F.A. Mason, Focal Press, pp. 226–229, 1966, U.S. Pats. Nos. 2,193,015 and 2,592,364, and Japanese Provisional Patent Publication No. 64933/1973, etc.

The color developing solution can otherwise contain pH buffuring agents such as sulfites, carbonates, borates and phosphates of alkali metals, development inhibitors or fog preventives such as bromides, iodides and organic fog preventives. Also, if necessary, hard water softeners, presevatives such as hydroxylamine, organic solvents such as benzyl alcohol, diethyleneglycol, development promotors such as polyethyleneglycol, quaternary ammonium salts, amines, dye forming couplers, competitive couplers, foggants such as sodium borohalide, auxiliary developing agents such as 1-phenyl-3-pyrazolidone, viscosity imparting agent, etc., may be also contained.

The photographic emulsion layer after color developing is generally subjected to bleaching processing. Bleaching processing may be conducted either simultaneously with fixing processing, or separately. As the bleaching agent, there may be employed compounds of polyvalent metals such as $Fe^{3+}$, $Co^{4+}$, $Cr^{6+}$, $Cu^{2+}$, etc., quinones, nitroso compounds, etc. For example, it is possible to use ferricyanides, chromic (III) acid salts, organic complexes of $Fe^{3+}$or $Co^{3+}$, for example, complexes of aminopolycarboxylic acids such as ethylenediaminetetraacetic acid, nitrilotriacetic acid, 1,3-diamino-2-propanoltetraacetic acid, etc., organic acids such as citric acid, tartaric acid, malic acid, etc.; persulfates, permanganates, nitrosophenol, etc. Among them, potassium ferricyanide, iron (III) sodium ethylenediamine tetraacetates and iron (III) ammonium ethylenediamine tetraacetate are particularly useful. Iron (III) ethylenediaminetetraacetate complex is useful in an independent bleaching solution and also in one bath bleach-fixing solution.

In the bleaching solution of bleach-fixing solution, it is also possible to add bleaching promotors as described in U.S. Pats. Nos. 3,042,520 and 3,241,966, Japanese Paten Publications No. 8506/1970 and No. 8836/1970, etc., thioether compounds as disclosed in Japanese Provisional Patent Publication No. 65732/1978, and other various additives.

Light exposure on the photographic emulsion to be used in the present invention by use of a light source, which may differ depending on the state of the optical sensitization, the purpose of use, etc., but suitably selected from many kinds such as tungsten, fluorescent lamp, mercury lamp, arc lamp, xenon, sunlight, xenon flash, cathode-ray cube flying spot, laser beam, electron beam, X-ray, fluorescent screen during X-ray photographing, etc.

The exposure time may be conventional exposure time from 1/1000 to 100 seconds, and also a short time exposure from $1/10^4$ to $1/10^9$ sec. for xenon flash, cathode-ray tube, laser beam.

EXAMPLES

The present invention is further described by referring to Examples. As a matter of course the present invention is not limited by these Examples.

EXAMPLE 1

(1) Preparation of poly-dispersed emulsion:

According to the normal mixing method, a poly-dispersed emulsion [A] was prepared. That is, four kinds of solutions shown below were first prepared.

| | | |
|---|---|---|
| Solution A: | silver nitrate | 100 g |
| | ammonia water (28%) | 78 cc |
| | added with water to | 240 cc |
| Solution B: | ossein gelatin | 8 g |
| | potassium bromide | 80 g |
| | potassium iodide | 1.3 g |
| | added with water to | 550 cc |
| Solution C: | ammonia water | 6 cc |
| | glacial acetic acid | 10 cc |
| | water | 34 cc |
| Solution D: | glacial acetic acid | 226 cc |
| | added with water to | 400 cc |

The solution B and the Solution C were injected into a reactor for preparation of emulsion and stirred by means of a propeller type stirrer at a rotational number of 300 rpm, and the reaction temperature was maintained at 55° C. Next, the Solution A was divided into proportions of 1 volume: 2 volume, of which 1 volume of 100 ml was thrown over 1 minute. After stirring was continued for 10 minute, 2 volumes of 200 ml which is the remainder of the solution A was thrown over 2 minutes, followed further by continuation of stirring for 30 minutes. And, with addition of the Solution D, the solution in the reactor was adjusted to pH 6 and the reaction was stopped. Thus, a poly-dispersed emulsion [A] was obtained. This emulsion contained 2.0 mole % of silver iodide, and the grains had a mean grain size of 1.21 μm.

Next, after the above emulsion was desalted according to the conventional flocculation method, to the desalted emulsion were added 60 mg/1 mole silver halide of ammonium thiocyanate, 1 mg/1 mole silver halide of chloroauric acid, 2 mg/1 mole silver halide of sodium thiosulfate to effect gold-sulfur sensitization, followed by addition of 1 g/1 mole silver halide of 4-hydroxy-6-methyl-1,3,3*a*,7-tetrazaindene (stabilizer) to obtain a light-sensitive silver iodobromide emulsion (a).

(2) Preparation of emulsion (b) having internal fog:

To an aqueous 2.5 wt. % of gelatin maintained at 55° C. were added at the same time an aqueous silver nitrate solution and an aqueous potassium bromide solution. After the addition, with the temperature of the solution maintained at 70° C., potassium hydroxide and silver nitrate were added and aged for 20 minutes to form fog nuclei. Then, after acetic acid was added to the solution maintained at 55° C. to effect neutralization, an aqueous silver nitrate solution and an aqueous potassium bromide solution were added at the same time to form coating. Desalting was effected according to the conventional floculation method, followed by re-dispersion in an aqueous gelatin solution to obtain an emulsion having internal fog with a mean grain size of 0.40 μm. To this emulsion was added 120 mg of 5-mercapto-1-phenyltetrazole per 1 mole of silver halide to give an emulsion B having internal fog.

(3) Preparation of test sample:

The light-sensitive silver halide emulsion (a) prepared in the above (1) and the emulsion (b) having internal fog prepared in the above (2) were mixed and dissolved at a ratio of 2:1. To this mixture was added polyhydric alcohols according to the present invention as indicated in Table 1, and further 200 mg/1 mole silver halide of nitron, 1.5 g/1 mole silver halide of sodium 2,4-dihydroxybenzene sulfonate and 1 g/1 mole silver halide of a copolymer of styrene and maleic acid were added, and the resultant mixture was applied on both surfaces of a polyester film base subjected to subbing treatment according to the method described in Japanese Provisional Patent Publication No. 19941/1984.

Further, an aqueous gelatin solution having the composition shown below was applied respectively on the emulsion surface to form a protective layer. The amount of silver coated was 4.5 g/m² for both surfaces, the amount of gelatin coated of the protective layer was 2.6 g/m² for both surfaces, and the amount of gelatin coated in the emulsion layer was 4.0 g/m².

Composition of aqueous gelatin solution:

| | |
|---|---|
| Lime-treated gelatin | 70 g |
| $NaO_3S-CH(CH_2-COOC_{10}H_{21})COOC_5H_{11}$ | 1.8 g |

-continued

| | |
|---|---|
| 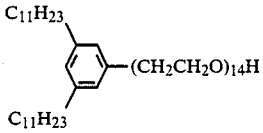 | 1.0 g |
| 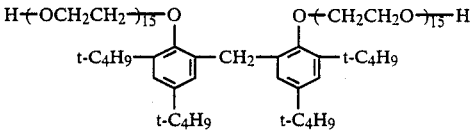 | 2.6 g |
| Ludox AM | 40 cc |
| 2,4-dichloro-6-hydroxy-1,3,5-triadine sodium salt | 1.0 g |

(4) Test method of test sample:

Samples as prepared above were subjected to wedge exposure at 3.2 CMS and then to developing processing by use of QX-1200 automatic developing machine produced by Konishiroku Photoindustry K.K. with the use of XD-90 developing processing solution and XF fixing processing solution at developing temperatures of 31° C., 35° C. and 37° C., respectively for 90 seconds, followed by measurement of photographic performances to obtain the results shown in Table 1.

As comparative samples, a sample prepared by coating only the photosensitive silver halide emulsion and a sample prepared by coating only the emulsion having internal fog in the same silver amount and gelatin amount were used.

Also, as comparative compounds of polyhydric alcohols, the following compounds were used.

| | Compound name | m.p. |
|---|---|---|
| (i) | Ethyleneglycol | −12.6° C. |
| (ii) | 1,4-Butanediol | 16° C. |
| (iii) | Glycerine | 18.2° C. |
| (iv) | 1,2,6-hexanetriol | −20° C. |

The sensitivity in Table 1 is a reciprocal value of exposure amount required for obtaining a darkening density of transmitted light of "fog value+1.0", and is represented as a relative value to that of sample 1 at a developing temperature of 35° C. as being 100. Also, for gamma, the gradient value of the characteristic curve between "fog value+0.2" and "fog value+1.0" was used. The fog value is a value containing the base density. Further, as comparative compound, the compound (v) used in Example 2 in Japanese Provisional Patent Publication No. 16694/1985 was used.

Compound (v)

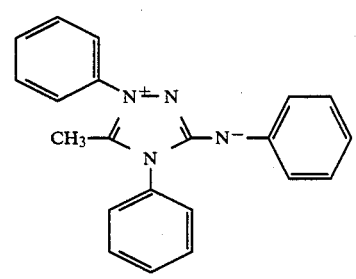

TABLE 1

Compound Amount

TABLE 1-continued

| Sample | added (Exemplary No.) | added g/mole AgX | Emulsion | Remarks | Fog 31° C. | Fog 32° C. | Fog 33° C. | Relative sensitivity 31° C. | Relative sensitivity 35° C. | Relative sensitivity 37° C. |
|---|---|---|---|---|---|---|---|---|---|---|
| 1 | — | — | Emulsion (a) | Comparative | 0.21 | 0.24 | 0.29 | 47 | 100 | 142 |
| 2 | — | — | Emulsion (b) | Comparative | 0.14 | 0.15 | 0.16 | 0.01 | 0.015 | 0.02 |
| 3 | — | — | Mixture of emulsions (a) and (b) | Comparative | 0.21 | 0.25 | 0.32 | 62 | 120 | 165 |
| 4 | (i) | 10 | Mixture of emulsions (a) and (b) | Comparative | 0.17 | 0.19 | 0.24 | 64 | 108 | 145 |
| 5 | (ii) | 15 | Mixture of emulsions (a) and (b) | Comparative | 0.16 | 0.18 | 0.23 | 65 | 112 | 143 |
| 6 | (iii) | 15 | Mixture of emulsions (a) and (b) | Comparative | 0.16 | 0.18 | 0.23 | 67 | 113 | 141 |
| 7 | (iv) | 22 | Mixture of emulsions (a) and (b) | Comparative | 0.18 | 0.20 | 0.25 | 62 | 105 | 145 |
| 8 | (v) | 0.5 | Mixture of emulsions (a) and (b) | Comparative | 0.15 | 0.17 | 0.19 | 54 | 90 | 126 |
| 9 | (v) | 1.0 | Mixture of emulsions (a) and (b) | Comparative | 0.15 | 0.16 | 0.18 | 47 | 70 | 99 |
| 10 | 2 | 17 | Mixture of emulsions (a) and (b) | This invention | 0.15 | 0.16 | 0.18 | 68 | 106 | 115 |
| 11 | 5 | 19 | Mixture of emulsions (a) and (b) | This invention | 0.15 | 0.17 | 0.19 | 67 | 108 | 125 |
| 12 | 10 | 28 | Mixture of emulsions (a) and (b) | This invention | 0.15 | 0.16 | 0.18 | 70 | 109 | 119 |
| 13 | 19 | 14 | Mixture of emulsions (a) and (b) | This invention | 0.15 | 0.16 | 0.18 | 69 | 106 | 119° |
| 14 | 20 | 23 | Mixture of emulsions (a) and (b) | This invention | 0.15 | 0.16 | 0.18 | 67 | 105 | 115 |
| 15 | 24 | 22 | Mixture of emulsions (a) and (b) | This invention | 0.15 | 0.17 | 0.19 | 66 | 109 | 120 |
| 16 | 30 | 22 | Mixture of emulsions (a) and (b) | This invention | 0.15 | 0.16 | 0.18 | 69 | 108 | 119 |
| 17 | 44 | 25 | Mixture of emulsions (a) and (b) | This invention | 0.15 | 0.16 | 0.18 | 65 | 103 | 113 |
| 18 | 49 | 30 | Mixture of emulsions (a) and (b) | This invention | 0.15 | 0.16 | 0.18 | 68 | 107 | 120 |

| Sample | Sensitivity difference 37° C. − 31° C. | Gamma 31° C. | Gamma 35° C. | Gamma 37° C. | Gamma difference/ 37° C. − 31° C. | Dmax at 35° C. | Remarks |
|---|---|---|---|---|---|---|---|
| 1 | 95 | 1.62 | 2.12 | 2.54 | 0.92 | 2.12 | Comparative |
| 2 | 0.01 | 4.1 | 5.0 | 5.7 | 1.6 | 4.83 | Comparative |
| 3 | 103 | 2.58 | 3.11 | 3.61 | 1.03 | 3.21 | Comparative |
| 4 | 81 | 2.83 | 3.18 | 3.57 | 0.74 | 3.18 | Comparative |
| 5 | 78 | 2.81 | 3.12 | 3.52 | 0.71 | 3.14 | Comparative |
| 6 | 74 | 2.82 | 3.14 | 3.54 | 0.72 | 3.16 | Comparative |
| 7 | 83 | 2.81 | 3.15 | 3.57 | 0.76 | 3.24 | Comparative |
| 8 | 72 | 2.19 | 2.54 | 2.81 | 0.62 | 2.62 | Comparative |
| 9 | 52 | 2.01 | 2.31 | 2.50 | 0.49 | 2.43 | Comparative |
| 10 | 47 | 2.85 | 3.12 | 3.33 | 0.48 | 3.21 | This invention |
| 11 | 58 | 2.84 | 3.16 | 3.40 | 0.56 | 3.24 | This invention |
| 12 | 49 | 2.82 | 3.11 | 3.29 | 0.47 | 3.20 | This invention |
| 13 | 50 | 2.86 | 3.14 | 3.35 | 0.49 | 3.23 | This invention |
| 14 | 48 | 2.85 | 3.11 | 3.30 | 0.45 | 3.21 | This invention |
| 15 | 54 | 2.83 | 3.17 | 3.37 | 0.54 | 3.24 | This invention |
| 16 | 50 | 2.82 | 3.13 | 3.26 | 0.44 | 3.23 | This invention |
| 17 | 48 | 2.81 | 3.10 | 3.28 | 0.47 | 3.20 | This invention |
| 18 | 52 | 2.82 | 3.12 | 3.28 | 0.46 | 3.22 | This invention |

As is apparent from Table 1, samples No. 10 to 18 by use of the compounds of the present invention exhibit good processing temperature dependency with small This means that polyhydric alcohols fullfill an entirely defferent action in the so called "trigger sensitive material" as compared with the action of polyhydric alcohols as the sensitizer in the general silver halide light-sensitive materials of the prior art.

That is, polyhydric alcohols having low melting points will be quickly flowed out from within the film by high temperature processing, whereby the "trigger effect" appears to be not controlled satisfactorily.

EXAMPLE 2

(1) Preparation of light-sensitive silver halide emulsion:

In the same manner as in Example 1, a poly-dispersed emulsion [C] was prepared. This emulsion contained 4 mole % of silver iodide and the grains had a mean grain size of 1.2 μm. Next, after the above emulsion was desalted according to the conventional flocculation method, 50 mg/1 mole silver halide of ammonium thiocyanate, 0.8 mg/1 mole silver halide of chloroauric acid and 1.6 mg/1 mole silver halide of sodium thiocyanate were added to effect gold-sulfur sensitization, followed by addition of 4-hydroxy-6-methyl-1,3,3*a*,7-tetrazaindene as the stabilizer in the same amount as in Example 1, to obtain a light-sensitive silver iodobromide emulsion (C).

(2) Preparation of emulsion having internal fog:

According to the method of Example 2 in Japanese Provisional Patent Publication No. 116535/1983, CuBrI grains containing 3.0 mole % of CuI with a mean grain size of 0.2 μm and, without performing water washing desalting treatment, subsequently fog nuclei were formed by light. Then, further by use of an appropriate amount of the same solution, coating was formed by a similar operation, water washing, desalting treatment of Example 1 in the above Japanese Provisional Patent Publication No. 116535/1983, followed by re-dispersion in an aqueous gelatin solution, to give an emulsion D having internal fog with a mean grain size of 0.40 μm.

(3) Preparation of test sample:

Samples were prepared in the same manner as in Example 1.

(4) Test method of test sample

Measurement of photographic performances was conducted similarly as in Example 1 to obtain the results shown in Table 2.

After processing in the same manner as in Example 1, as apparently seen from Table 2, the samples No. 10–18 by use of the compounds of the present invention exhibit good processing temperature dependency with small change width in fog, sensitivity and gamma by the changes in the processing temperature.

TABLE 2

| Sample | Compound added (Exemplary No.) | Amount added g/mole AgX | Emulsion | Remarks | Fog 31° C. | Fog 32° C. | Fog 33° C. | Relative sensitivity 31° C. | Relative sensitivity 35° C. | Relative sensitivity 37° C. |
|---|---|---|---|---|---|---|---|---|---|---|
| 1 | — | — | Emulsion (c) | Comparative | 0.20 | 0.23 | 0.28 | 40 | 100 | 133 |
| 2 | — | — | Emulsion (d) | Comparative | 0.14 | 0.15 | 0.16 | 0.001 | 0.002 | 0.004 |
| 3 | — | — | Mixture of emulsions (c) and (d) | Comparative | 0.22 | 0.26 | 0.36 | 54 | 105 | 150 |
| 4 | (i) | 15 | Mixture of emulsions (c) and (d) | Comparative | 0.18 | 0.21 | 0.29 | 57 | 98 | 122 |
| 5 | (ii) | 22 | Mixture of emulsions (c) and (d) | Comparative | 0.17 | 0.20 | 0.27 | 59 | 101 | 122 |
| 6 | (iii) | 22 | Mixture of emulsions (c) and (d) | Comparative | 0.17 | 0.20 | 0.27 | 60 | 103 | 120 |
| 7 | (iv) | 33 | Mixture of emulsions (c) and (d) | Comparative | 0.19 | 0.22 | 0.30 | 55 | 96 | 132 |
| 8 | (v) | 1.0 | Mixture of emulsions (c) and (d) | Comparative | 0.16 | 0.19 | 0.24 | 49 | 80 | 106 |
| 9 | (v) | 2.0 | Mixture of emulsions (c) and (d) | Comparative | 0.16 | 0.18 | 0.20 | 43 | 65 | 85 |
| 10 | 2 | 25 | Mixture of emulsions (c) and (d) | This invention | 0.15 | 0.16 | 0.18 | 58 | 86 | 101 |
| 11 | 5 | 29 | Mixture of emulsions (c) and (d) | This invention | 0.15 | 0.18 | 0.20 | 60 | 87 | 104 |
| 12 | 10 | 42 | Mixture of emulsions (c) and (d) | This invention | 0.15 | 0.16 | 0.18 | 61 | 88 | 100 |
| 13 | 19 | 21 | Mixture of emulsions (c) and (d) | This invention | 0.15 | 0.17 | 0.19 | 61 | 87 | 101 |
| 14 | 20 | 34 | Mixture of emulsions (c) and (d) | This invention | 0.15 | 0.16 | 0.18 | 59 | 86 | 102 |
| 15 | 24 | 32 | Mixture of emulsions (c) and (d) | This invention | 0.15 | 0.18 | 0.20 | 58 | 87 | 99 |
| 16 | 30 | 32 | Mixture of emulsions (c) and (d) | This invention | 0.15 | 0.16 | 0.18 | 61 | 87 | 101 |
| 17 | 44 | 37 | Mixture of emulsions (c) and (d) | This invention | 0.15 | 0.16 | 0.18 | 60 | 88 | 102 |
| 18 | 49 | 44 | Mixture of emulsions (c) and (d) | This invention | 0.15 | 0.16 | 0.18 | 60 | 86 | 101 |

| Sample | Sensitivity difference 37° C. – 31° C. | Gamma 31° C. | Gamma 35° C. | Gamma 37° C. | Gamma difference/ 37° C. – 31° C. | Dmax at 35° C. | Remarks |
|---|---|---|---|---|---|---|---|
| 1 | 93 | 1.13 | 1.57 | 2.03 | 0.90 | 1.57 | Comparative |
| 2 | 0.003 | 3.8 | 4.6 | 5.2 | 1.4 | 4.6 | Comparative |
| 3 | 96 | 2.71 | 3.46 | 3.95 | 1.24 | 3.32 | Comparative |
| 4 | 65 | 3.15 | 3.54 | 4.04 | 0.89 | 3.28 | Compara- |

TABLE 2-continued

| | | | | | | | |
|---|---|---|---|---|---|---|---|
| | | | | | | | tive |
| 5 | 63 | 3.13 | 3.47 | 3.98 | 0.85 | 3.26 | Comparative |
| 6 | 60 | 3.14 | 3.50 | 4.01 | 0.87 | 3.27 | Comparative |
| 7 | 77 | 3.12 | 3.51 | 4.03 | 0.91 | 3.27 | Comparative |
| 8 | 57 | 2.44 | 2.80 | 3.19 | 0.75 | 2.47 | Comparative |
| 9 | 42 | 2.24 | 2.54 | 2.83 | 0.59 | 2.21 | Comparative |
| 10 | 43 | 3.17 | 3.47 | 3.71 | 0.54 | 3.29 | This invention |
| 11 | 44 | 3.16 | 3.50 | 3.78 | 0.62 | 3.29 | This invention |
| 12 | 39 | 3.14 | 3.46 | 3.66 | 0.52 | 3.26 | This invention |
| 13 | 40 | 3.18 | 3.49 | 3.72 | 0.54 | 3.28 | This invention |
| 14 | 43 | 3.17 | 3.47 | 3.67 | 0.50 | 3.27 | This invention |
| 15 | 41 | 3.15 | 3.52 | 3.75 | 0.60 | 3.30 | This invention |
| 16 | 40 | 3.14 | 3.48 | 3.63 | 0.49 | 3.28 | This invention |
| 17 | 42 | 3.13 | 3.46 | 3.64 | 0.51 | 3.26 | This invention |
| 18 | 41 | 3.14 | 3.48 | 3.64 | 0.50 | 3.28 | This invention |

EXAMPLE 3

Preparation of internally fogged emulsion:

Emulsion I

A 2% gelatin solution was stirred while maintained at 60° C., and an aqueous silver nitrate solution and an aqueous halide solution containing potassium bromide and sodium chloride were added at the same time. The finished mean grain size was controlled by changing the time over which the aqueous silver nitrate solution and the aqueous halide solution were added.

After completion of the addition, this solution was lowered to a temperature of 40° C., at which desalting treatment was conducted to give a silver chlorobromide emulsion with a mean grain size of 0.25 μm (ratio of AgBr and AgCl 30:70). pH was 6.0 and pAg was 7.4.

To the resultant core emulsion maintained at 60° C. were added an aqueous silver nitrate solution and an aqueous sodium hydroxide solution in appropriate amounts, followed by ripening for 50 minutes, to form fog nuclei. By controlling pH to 6.0 and pAg to 7.3, an aqueous silver nitrate solution and an aqueous solution containing potassium bromide and potassium iodide were further added at the same time over 40 minites. After desalting treatment, 150 mg of 5-mercapto-1-phenyltetrazole was added per 1 mole of silver halide to give an internally fogged Emulsion I.

This emulsion was found to have a mean grain size (r) of 0.34 μm and $\sigma/r$ of 0.12.

Emulsion II

The core emulsion obtained similarly as in Emulsion I was maintained at 60° C., and an aqueous silver nitrate solution and an aqueous chloroauric acid solution were added, followed by ripening for 50 minutes to form fog nuclei. pAg was adjusted to 7.3 with an aqueous potassium bromide solution, and further an aqueous silver nitrate solution and an aqueous solution containing potassium bromide and potassium iodide were added at the same time. After the desalting treatment, 150 mg of 5-mercapto-1-phenyltetrazole was added per 1 mole of silver halide to give an internally fogged Emulsion II.

This emulsion was found to have a mean grain size (r) of 0.34 μm and $\sigma/r$ of 0.12.

Emulsion III

The core emulsion obtained in the same manner as in Emulsion I was maintained at 60° C., and an aqueous sodium borohydride solution was added thereto, followed by ripening for 50 minutes to form fog nuclei. pAg was adjusted to 7.3, and further an aqueous silver nitrate solution and an aqueous solution containing potassium bromide and potassium iodide were added at the same time. After desalting treatment, 150 mg of 5-mercapto-1-phenyltetrazole was added per 1 mole of silver halide to give an internally fogged Emulsion III.

This emulsion was found to have a mean grain size (r) of 0.34 μm and $\sigma/r$ of 0.11.

Emulsion IV

The core emulsion obtained in the same manner as in Emulsion I was maintained at 60° C., and after addition of an aqueous silver nitrate solution, hydrazine and an aqueous chloroauric acid were added, followed by ripening for 50 minutes to form fog nuclei. pAg was adjusted to 7.3, and further an aqueous silver nitrate solution and an aqueous solution containing potassium bromide and potassium iodide were added at the same time. After desalting treatment, 150 mg of 5-mercapto-1-phenyltetrazole was added per 1 mole of silver halide to give an internally fogged Emulsion IV.

This emulsion was found to have a mean grain size (r) of 0.35 μm and $\sigma/r$ of 0.12.

Emulsion V

The core emulsion obtained in the same manner as in Emulsion I was maintained at 60° C., and an aqueous silver nitrate solution was adde, and further an aqueous sodium thiosulfate solution and an aqueous potassium chloroaurate solution were added, followed by ripening for 50 minutes to form fog nuclei. pAg was adjusted to 7.3, and further an aqueous silver nitrate solution and an aqueous solution containing potassium bromide and potassium iodide were added at the same time. After desalting treatment, 150 mg of 5-mercapto-1-phenyltetrazole was added per 1 mole of silver halide to obtain an internally fogged Emulsion V.

This emulsion was found to have a mean grain size (r) of 0.35 μm and σ/r of 0.11.

Emulsion VI

The core emulsion obtained in the same manner as in Emulsion I was maintained at 60° C., and an aqueous stannous chloride was added, followed by ripening for 50 minutes to form fog nuclei. pAg was adjusted to 7.3, and further an aqueous silver nitrate solution and an aqueous solution containing potassium bromide and potassium iodide were added at the same time. After desalting treatment, 150 mg of 5-mercapto-1-phenyltetrazole was added per 1 mole of silver halide to give an internally fogged Emulsion VI.

This emulsion was found to have a mean grain size (r) of 0.34 μm and σ/r of 0.12.

Emulsion VII

The core emulsion obtained in the same manner as in Emulsion I was maintained at 60° C., and an aqueous formaldehyde solution and an aqueous sodium hydroxide solution were added, followed by ripening for 50 minutes to form fog nuclei. pAg was adjusted to 7.3 and pH to 6.0, and further an aqueous silver nitrate solution and aqueous solution containing potassium bromide and potassium iodide were added at the same time. After desalting treatment, 150 mg of 5-mercapto-1-phenyltetrazole was added per 1 mole of silver halide to give an internally fogged Emulsion (VII).

This emulsion was found to have a mean grain size (r) of 0.34 μm and σ/r of 0.11.

Emulsion VIII

The core emulsion obtained in the same manner as in Emulsion I was maintain at 60° C., and an aqueous thiourea dioxide solution was added, followed by ripening for 50 minutes to form fog nuclei. pAg was adjusted to 7.3, and further an aqueous silver nitrate solution and aqueous solution containing potassium bromide and potassium iodide were added at the same time. After desalting treatment, 150 mg of 5-mercapto-1-phenyltetrazole was added per 1 mole of silver halide to give an internally fogged Emulsion VIII.

This emulsion was found to have a mean grain size (r) of 0.34 μm and σ/r of 0.12.

Emulsion IX

The core emulsion obtained in the same manner as in Emulsion I was maintained at 60° C., and an aqueous thiourea dioxide solution and an aqueous silver nitrate solution were added, followed by ripening for 50 minutes to form fog nuclei. pAg was adjusted to 7.3, and further an aqueous silver nitrate solution and aqueous solution containing potassium bromide and potassium iodide were added at the same time. After desalting treatment, 150 mg of 5-mercapto-1-phenyltetrazole was added per 1 mole of silver halide to give an internally fogged Emulsion IX.

This emulsion was found to have a mean grain size (r) of 0.34 μm and σ/r of 0.12.

Emulsion X

The core emulsion obtained in the same manner as in Emulsion I was maintain at 60° C., and an aqueous thiourea dioxide solution and an aqueous chloroauric solution was added, followed by ripening for 50 minutes to form fog nuclei. pAg was adjusted to 7.3, and further an aqueous silver nitrate solution and aqueous solution containing potassium bromide and potassium iodide were added at the same time. After desalting treatment, 150 mg of 5-mercapto-1-phenyl-tetrazole was added per 1 mole of silver halide to give an internally fogged Emulsion X.

This emulsion was found to have a mean grain size (r) of 0.34 μm and σ/r of 0.11.

Emulsion XI

The core emulsion obtained in the same manner as in Emulsion I was maintained at 60° C., adjusted to pH=7.0 with an aqueous sodium hydroxide solution, and an aqueous thiourea dioxide solution was added, followed by ripening for 50 minutes to form forg nuclei. After adjustment pH=6.0 and pAg=7.3, and aqueous silver nitrate solution and a solution containing potassium bromide and potassium iodide were added at the same time. After desalting treatment, 150 mg of 5-mercapto-1-phenyltetrazole was added per 1 mole of silver halide to give an internally fogged Emulsion XI.

This emulsion was found to have a mean grain size (r) of 0.35 μm and σ/r of 0.12.

Emulsion XII

The core emulsion obtained in the same manner as in Emulsion I was maintained at 60° C., adjusted to pH=7.0 with an aqueous sodium hydroxide solution, and an aqueous thiourea dioxide solution and an aqueous chloroauric acid solution were added, followed by ripening for 50 minutes to form forg nuclei. After adjustment pH=6.0 and pAg=7.3, and aqueous silver nitrate solution and a solution containing potassium bromide and potassium iodide were added at the same time. After desalting treatment, 150 mg of 5-mercapto-1-phenyltetrazole was added per 1 mole of silver halide to give an internally fogged Emulsion XII.

This emulsion was found to have a mean grain size (r) of 0.35 μm and σ/r of 0.11.

Emulsion XIII

The core emulsion obtained in the same manner as in Emulsion I was maintained at 60° C., adjusted to pH=8.0 with an aqueous sodium hydroxide solution, and an aqueous thiourea dioxide solution and an aqueous chloroauric acid solution were added, followed by ripening for 50 minutes to form fog nuclei. After adjustment pH=6.0 and pAg=7.3, and aqueous silver nitrate solution and a solution containing potassium bromide and potassium iodide were added at the same time. After desalting treatment, 150 mg of 5-mercapto-1-phenyltetrazole was added per 1 mole of silver halide to give an internally fogged Emulsion XIII.

This emulsion was found to have a mean grain size (r) of 0.35 μm and σ/r of 0.12.

Preparation of samples and test results:

The surface latent image type emulsion A (which was prepared by the same manner as in the poly-dispersed emulsion [A] in Example 1), Exemplary compound No. 30 as a polyhydric alcohol and each of the internally fogged emulsions I-XIII was mixed to a ratio of 4:1, and further the compound represented by the formula [I] was added in the amount indicated in Table 3 and the resultant mixture was applied on both surfaces of a polyethylene-terephthalate support to a silver quantity of 5.0 g/m$^2$. Also, for comparative purpose, only the Emulsion A was applied in the same manner to a silver quantity of 7.0 g/m$^2$.

Further, on these emulsion layers protective layers were formed by coating a mixture prepared by adding gelatin, polymethyl methacrylate and glycidol addition polymer of phenol-formalin condensate and mixing with film hardening agents of formalin and glyoxal. Subsequently, raw stock stability tests were conducted under the conditions shown in Table 3 and standard exposure was given through an optical wedge at intervals of 0.15 density followed by continuous developing, fixing and water washing steps to carry out high temperature rapid processing at 35° C. for 20 seconds according to the developing solution recipe 1 shown below by use of a continuous roller conveying system automatic developing machine.

| (Developing solution recipe 1) | |
|---|---|
| Anhydrous sodium sulfite | 70 g |
| Hydroquinone | 10 g |
| Anhydrous boric acid | 1 g |
| Sodium carbonate monohydrate | 20 g |
| 1-Phenyl-3-pyrazolidone | 0.35 g |
| Sodium hydroxide | 5 g |
| 5-Methyl-benzotriazole | 0.05 g |
| Potassium bromide | 5 g |
| Glutaraldehyde bisulfite | 15 g |
| Glacial acetic acid | 8 g |
| (made up to 1 liter with addition of water) | |

The results are shown in Table 3. Graininess was evaluated at 5 ranks.

5; very good, 4; good, 3; practically involving problem, 2; inferior, 1; very inferior.

As is apparent from the Table, the samples according to the present invention, in spite of small silver quantity coated of 5.0 g/m$^2$, give high sensitivity, high Dmax, high gamma, and yet no increase in fog is recognized at all, exhibiting good graininess and further small increase in fog when samples are stored under highly humid and high temperature conditions.

TABLE 3

| Sample No. | Internal fogged emulsion 1.0 g/m$^2$ | Surface latent type emulsion A [g/m$^2$] | Compound mole/mole Ag | Naturally allowed to stand 3 days | | | | | 50° C., 80% RH; 3 days | | | | Remarks |
|---|---|---|---|---|---|---|---|---|---|---|---|---|---|
| | | | | Sensitivity | Dmax | Fog | Gamma | Graininess | Sensitivity | Dmax | Fog | Gamma | |
| 19 | — | 7.0 | None | 100 | 3.20 | 0.02 | 2.9 | 5 | 90 | 3.10 | 0.04 | 2.8 | Comparative |
| 20 | I | 4.0 | None | 80 | 2.76 | 0.03 | 2.5 | 4 | 72 | 2.60 | 0.06 | 2.3 | |
| 21 | II | 4.0 | None | 92 | 3.10 | 0.03 | 2.8 | 3 | 87 | 3.02 | 0.07 | 2.7 | |
| 22 | III | 4.0 | None | 110 | 3.32 | 0.05 | 3.10 | 2 | 96 | 3.30 | 0.20 | 2.9 | |
| 23 | IV | 4.0 | None | 114 | 3.40 | 0.06 | 3.15 | 2 | 100 | 3.38 | 0.24 | 3.0 | |
| 24 | V | 4.0 | None | 79 | 2.65 | 0.02 | 2.3 | 5 | 75 | 2.60 | 0.16 | 2.3 | |
| 25 | VI | 4.0 | None | 108 | 3.30 | 0.06 | 3.10 | 2 | 100 | 3.28 | 0.26 | 2.9 | |
| 26 | VII | 4.0 | None | 110 | 3.20 | 0.06 | 3.08 | 3 | 100 | 3.00 | 0.24 | 2.7 | |
| 27 | VIII | 4.0 | None | 120 | 3.40 | 0.05 | 3.3 | 2 | 110 | 3.36 | 0.13 | 3.2 | |
| 28 | IX | 4.0 | None | 120 | 3.38 | 0.05 | 3.28 | 2 | 110 | 3.35 | 0.14 | 3.2 | |
| 29 | X | 4.0 | None | 126 | 3.45 | 0.05 | 3.4 | 2 | 120 | 3.40 | 0.13 | 3.3 | |
| 30 | XI | 4.0 | None | 130 | 3.46 | 0.05 | 3.42 | 2 | 120 | 3.43 | 0.11 | 3.4 | |
| 31 | XII | 4.0 | None | 130 | 3.50 | 0.06 | 3.5 | 2 | 126 | 3.45 | 0.11 | 3.46 | |
| 32 | XIII | 4.0 | None | 132 | 3.50 | 0.06 | 3.5 | 2 | 125 | 3.48 | 0.10 | 3.48 | |
| 33 | I | 4.0 | I - 8/1.0 × $10^{-4}$ | 70 | 2.74 | 0.02 | 2.4 | 5 | 63 | 2.66 | 0.03 | 2.3 | |
| 34 | II | 4.0 | I - 8/1.0 × $10^{-4}$ | 82 | 3.05 | 0.02 | 2.7 | 5 | 77 | 3.00 | 0.03 | 2.5 | |
| 35 | III | 4.0 | I - 8/1.0 × $10^{-4}$ | 103 | 3.30 | 0.02 | 3.05 | 5 | 97 | 3.27 | 0.04 | 3.0 | This invention |
| 36 | IV | 4.0 | I - 8/1.0 × $10^{-4}$ | 107 | 3.38 | 0.03 | 3.1 | 5 | 100 | 3.34 | 0.04 | 3.0 | |
| 37 | V | 4.0 | I - 8/1.0 × $10^{-4}$ | 70 | 2.63 | 0.02 | 2.2 | 5 | 62 | 2.60 | 0.03 | 2.0 | Comparative |
| 38 | VI | 4.0 | I - 8/1.0 × $10^{-4}$ | 100 | 3.30 | 0.03 | 3.1 | 5 | 90 | 3.26 | 0.04 | 3.1 | This invention |
| 39 | VII | 4.0 | I - 8/1.0 × $10^{-4}$ | 102 | 3.17 | 0.03 | 3.1 | 5 | 93 | 3.10 | 0.04 | 3.1 | |
| 40 | VIII | 4.0 | I - 8/1.0 × $10^{-4}$ | 110 | 3.40 | 0.02 | 3.3 | 5 | 100 | 3.38 | 0.02 | 3.3 | |
| 41 | IX | 4.0 | I - 8/1.0 × $10^{-4}$ | 110 | 3.39 | 0.02 | 3.3 | 5 | 103 | 3.35 | 0.02 | 3.2 | |
| 42 | X | 4.0 | I - 8/1.0 × $10^{-4}$ | 114 | 3.45 | 0.02 | 3.4 | 5 | 108 | 3.40 | 0.02 | 3.3 | |
| 43 | XI | 4.0 | I - 8/1.0 × $10^{-4}$ | 118 | 3.45 | 0.02 | 3.45 | 4 | 110 | 3.41 | 0.02 | 3.4 | |
| 44 | XII | 4.0 | I - 8/1.0 × $10^{-4}$ | 120 | 3.47 | 0.03 | 3.5 | 4 | 115 | 3.43 | 0.03 | 3.45 | |
| 45 | XIII | 4.0 | I - 8/1.0 × $10^{-4}$ | 125 | 3.50 | 0.02 | 3.5 | 4 | 120 | 3.48 | 0.02 | 3.47 | |
| 46 | I | 4.0 | I - 4/1.0 × $10^{-4}$ | 72 | 2.76 | 0.02 | 2.4 | 5 | 62 | 2.68 | 0.03 | 2.4 | Comparative |
| 47 | II | 4.0 | I - 4/1.0 × $10^{-4}$ | 83 | 3.07 | 0.02 | 2.6 | 5 | 77 | 3.00 | 0.03 | 2.5 | |
| 48 | III | 4.0 | I - 4/1.0 × $10^{-4}$ | 102 | 3.28 | 0.02 | 3.07 | 5 | 98 | 3.27 | 0.04 | 3.0 | This invention |
| 49 | IV | 4.0 | I - 4/1.0 × $10^{-4}$ | 105 | 3.37 | 0.03 | 3.1 | 5 | 100 | 3.30 | 0.05 | 3.0 | |
| 50 | V | 4.0 | I - 4/1.0 × $10^{-4}$ | 70 | 2.62 | 0.01 | 2.3 | 5 | 65 | 2.59 | 0.02 | 2.1 | Comparative |
| 51 | VI | 4.0 | I - 4/1.0 × $10^{-4}$ | 100 | 3.30 | 0.02 | 3.1 | 5 | 91 | 3.25 | 0.05 | 3.1 | This invention |
| 52 | VII | 4.0 | I - 4/1.0 × $10^{-4}$ | 100 | 3.20 | 0.03 | 3.1 | 5 | 91 | 3.10 | 0.04 | 3.0 | |
| 53 | VIII | 4.0 | I - 4/1.0 × $10^{-4}$ | 113 | 3.42 | 0.02 | 3.2 | 5 | 103 | 3.40 | 0.03 | 3.0 | |
| 54 | IX | 4.0 | I - 4/1.0 × $10^{-4}$ | 113 | 3.40 | 0.02 | 3.3 | 5 | 109 | 3.37 | 0.03 | 3.1 | |
| 55 | X | 4.0 | I - 4/1.0 × $10^{-4}$ | 116 | 3.45 | 0.02 | 3.4 | 4 | 110 | 3.40 | 0.03 | 3.3 | |
| 56 | XI | 4.0 | I - 4/1.0 × $10^{-4}$ | 118 | 3.46 | 0.02 | 3.4 | 4 | 110 | 3.42 | 0.02 | 3.3 | |
| 57 | XII | 4.0 | I - 4/1.0 × $10^{-4}$ | 122 | 3.50 | 0.02 | 3.45 | 4 | 116 | 3.47 | 0.02 | 3.4 | |
| 58 | XIII | 4.0 | I - 4/1.0 × $10^{-4}$ | 124 | 3.51 | 0.02 | 3.5 | 4 | 118 | 3.47 | 0.02 | 3.45 | |

EXAMPLE 4

The samples prepared in Example 3 were subjected to developing at 20° C. for 3 minutes according to the developing solution recipe 2 shown below. The results are shown in Table 4.

As is apparent from the Table, the samples of the present invention, even by developing at low temperature within short time, can give high sensitivity, high Dmax and high gamma, and yet substantially without increase in fog and with excellent graininess.

| (Developing solution recipe 2) | |
|---|---|
| Anhydrous sodium sulfite | 70 g |
| Hydroquinone | 9 g |
| Sodium carbonate monohydrate | 35 g |
| 1-Phenyl-3-pyrazolidone | 0.4 g |
| Potassium bromide | 4 g |
| Benztriazole | 4 mg |
| (made up to 1 liter with addition of water) | |

TABLE 4

| Sample No. | Internal fogged emulsion 1.0 g/m$^2$ | Surface latent type emulsion A [g/m$^2$] | Compound mole/mole Ag | Developing solution treatment 2 20° C. for 3 minutes Sensitivity | Dmax | Fog | Gamma | Graininess | Remarks |
|---|---|---|---|---|---|---|---|---|---|
| 19 | — | 7.0 | None | 100 | 2.60 | 0.02 | 1.80 | 5 | Comparative |
| 20 | I | 4.0 | None | 90 | 2.80 | 0.03 | 2.4 | 4 | |
| 21 | II | 4.0 | None | 100 | 3.00 | 0.03 | 2.5 | 4 | |
| 22 | III | 4.0 | None | 130 | 3.20 | 0.08 | 3.00 | 3 | |
| 23 | IV | 4.0 | None | 135 | 3.24 | 0.10 | 3.03 | 3 | |
| 24 | V | 4.0 | None | 92 | 2.82 | 0.03 | 2.4 | 5 | |
| 25 | VI | 4.0 | None | 130 | 3.20 | 0.10 | 3.02 | 3 | |
| 26 | VII | 4.0 | None | 135 | 3.22 | 0.12 | 3.0 | 3 | |
| 27 | VIII | 4.0 | None | 140 | 3.21 | 0.08 | 3.0 | 3 | |
| 28 | IX | 4.0 | None | 140 | 3.22 | 0.08 | 3.1 | 3 | |
| 29 | X | 4.0 | None | 151 | 3.24 | 0.08 | 3.2 | 3 | |
| 30 | XI | 4.0 | None | 156 | 3.22 | 0.09 | 3.2 | 3 | |
| 31 | XII | 4.0 | None | 155 | 3.23 | 0.09 | 3.2 | 3 | |
| 32 | XIII | 4.0 | None | 160 | 3.23 | 0.09 | 3.3 | 2 | |
| 33 | I | 4.0 | I - 8/1.0 × $10^{-4}$ | 82 | 2.70 | 0.02 | 2.5 | 5 | |
| 34 | II | 4.0 | I - 8/1.0 × $10^{-4}$ | 90 | 3.01 | 0.02 | 2.5 | 5 | |
| 35 | III | 4.0 | I - 8/1.0 × $10^{-4}$ | 117 | 3.18 | 0.03 | 3.0 | 5 | This |
| 36 | IV | 4.0 | I - 8/1.0 × $10^{-4}$ | 120 | 3.24 | 0.03 | 3.0 | 4 | invention |
| 37 | V | 4.0 | I - 8/1.0 × $10^{-4}$ | 84 | 2.72 | 0.02 | 2.4 | 5 | Comparative |
| 38 | VI | 4.0 | I - 8/1.0 × $10^{-4}$ | 115 | 3.20 | 0.03 | 3.0 | 4 | This |
| 39 | VII | 4.0 | I - 8/1.0 × $10^{-4}$ | 120 | 3.20 | 0.03 | 3.1 | 4 | invention |
| 40 | VIII | 4.0 | I - 8/1.0 × $10^{-4}$ | 126 | 3.21 | 0.02 | 3.1 | 5 | |
| 41 | IX | 4.0 | I - 8/1.0 × $10^{-4}$ | 126 | 3.21 | 0.02 | 3.1 | 5 | |
| 42 | X | 4.0 | I - 8/1.0 × $10^{-4}$ | 130 | 3.22 | 0.03 | 3.2 | 5 | |
| 43 | XI | 4.0 | I - 8/1.0 × $10^{-4}$ | 135 | 3.23 | 0.03 | 3.2 | 5 | |
| 44 | XII | 4.0 | I - 8/1.0 × $10^{-4}$ | 135 | 3.22 | 0.03 | 3.3 | 5 | |
| 45 | XIII | 4.0 | I - 8/1.0 × $10^{-4}$ | 140 | 3.22 | 0.03 | 3.3 | 4 | |
| 46 | I | 4.0 | I - 4/1.0 × $10^{-4}$ | 80 | 2.74 | 0.02 | 2.4 | 5 | Comparative |
| 47 | II | 4.0 | I - 4/1.0 × $10^{-4}$ | 91 | 3.00 | 0.02 | 2.5 | 5 | |
| 48 | III | 4.0 | I - 4/1.0 × $10^{-4}$ | 116 | 3.16 | 0.03 | 3.0 | 5 | This |
| 49 | IV | 4.0 | I - 4/1.0 × $10^{-4}$ | 118 | 3.22 | 0.03 | 3.0 | 4 | invention |
| 50 | V | 4.0 | I - 4/1.0 × $10^{-4}$ | 82 | 2.70 | 0.02 | 2.45 | 5 | Comparative |
| 51 | VI | 4.0 | I - 4/1.0 × $10^{-4}$ | 112 | 3.18 | 0.03 | 3.1 | 4 | This |
| 52 | VII | 4.0 | I - 4/1.0 × $10^{-4}$ | 118 | 3.20 | 0.04 | 3.1 | 4 | invention |
| 53 | VIII | 4.0 | I - 4/1.0 × $10^{-4}$ | 125 | 3.22 | 0.02 | 3.0 | 5 | |
| 54 | IX | 4.0 | I - 4/1.0 × $10^{-4}$ | 124 | 3.21 | 0.02 | 3.1 | 5 | |
| 55 | X | 4.0 | I - 4/1.0 × $10^{-4}$ | 130 | 3.23 | 0.03 | 3.2 | 5 | |
| 56 | XI | 4.0 | I - 4/1.0 × $10^{-4}$ | 137 | 3.23 | 0.03 | 3.2 | 5 | |
| 57 | XII | 4.0 | I - 4/1.0 × $10^{-4}$ | 136 | 3.23 | 0.03 | 3.3 | 4 | |
| 58 | XIII | 4.0 | I - 4/1.0 × $10^{-4}$ | 143 | 3.23 | 0.03 | 3.3 | 4 | |

EXAMPLE 5

Preparation of internally fogged emulsion:

Emulsion XIV

A 2% gelatin solution was stirred while maintained at 60° C. and an aqueous silver nitrate solution and an aqueous halide solution containing potassium bromide and sodium chloride were added at the same time. The finished mean grain size was controlled by changing the time over which the aqueous silver nitrate solution and the aqueous halide solution were added.

After completion of the addition, the solution was lowered to a temperature of 40° C. at which desalting treatment was conducted to give a silver chlorobromide emulsion with a mean grain size of 0.25 μm (ratio of AgBr and AgCl 70:30). pH was 6.0 and pAg was 7.4.

The core emulsion obtained was maintained at 60° C., controlled to pH=8.0 with an aqueous sodium hydroxide solution, and an aqueous thiourea dioxide solution and an aqueous chloroauric acid solution were added, followed by ripening for 50 minutes to form fog nuclei. After adjustment of pH=6.0 and pAg=7.3, an aqueous silver nitrate solution and an aqueous solution containing potassium bromide and potassium iodide were added at the same time. After desalting treatment, 150 mg of 5-mercapto-1-phenyltetrazole was added per 1 mole of silver halide to give an internally fogged Emulsion XIV.

This emulsion was found to have a mean grain size (r) of 0.34 μm and σ/r of 0.11.

Emulsion XV

A 2% gelatin solution was stirred while maintained at 60° C., and an aqueous silver nitrate solution and an aqueous halide solution containing potassium bromide and sodium chloride were added at the same time. The finished mean grain size was controlled by changing the time over which the aqueous silver nitrate solution and the aqueous halide solution were added.

After completion of the addition, the solution was lowered to a temperature of 40° C. at which desalting treatment was conducted to obtain a silver chlorobromide emulsion with a mean grain size of 0.25 μm (ratio of AgBr and AgCl 90:10). pH was 6.0 and pAg was 7.4.

The core emulsion obtained was maintained at 60° C., controlled to pH=8.0 with an aqueous sodium hydroxide solution and an aqueous thiourea dioxide solution and an aqueous chloroauric acid solution were added, followed by ripening for 50 minutes to form fog nuclei. After adjustment of pH=6.0, pAg=7.3, an aqueous silver nitrate solution and an aqueous solution containing potassium bromide and potassium iodide were added at the same time. After desalting treatment, 150 mg of 5-mercapto-1-phenyltetrazole was added per 1 mole of silver halide to give an internally fogged Emulsion XV.

This emulsion was found to have a mean grain size (r) of 0.34 μm and σ/r of 0.12.

Emulsion XVI

A 2% gelatin solution was stirred while maintained at 60° C., and an aqueous silver nitrate solution and an aqueous potassium bromide solution was added at the same time. The finished mean grain size was controlled by changing the time over which the aqueous silver nitrate solution and the aqueous halide solution were added.

After completion of the addition, the solution was lowered to a temperature of 40° C. at which desalting treatment was conducted to obtain a silver chlorobromide emulsion with a mean grain size of 0.25 μm. pH was 6.0 and pAg was 7.4.

The core emulsion obtained was maintained at 60° C., controlled to pH=8.0 with an aqueous sodium hydroxide solution and an aqueous thiourea dioxide solution and an aqueous chloroauric acid solution were added, followed by ripening for 50 minutes to form fog nuclei. After adjustment of pH=6.0, pAg=7.3, an aqueous silver nitrate solution and an aqueous solution containing potassium bromide and potassium iodide were added at the same time. After desalting treatment, 150 mg of 5-mercapto-1-phenyltetrazole was added per 1 mole of silver halide to give an internally fogged Emulsion XV.

This emulsion was found to have a mean grain size (r) of 0.34 μm and σ/r of 0.12.

Emulsion XVII

A 2% gelatin solution was stirred while maintained at 60° C., and an aqueous silver nitrate solution and an aqueous halide solution containing potassium bromide and sodium chloride were added at the same time. The finished mean grain size was controlled by changing the time over which the aqueous silver nitrate solution and the aqueous halide solution were added.

After completion of the addition, the solution was lowered to a temperature of 40° C. at which desalting treatment was conducted to obtain a silver chlorobromide emulsion with a mean grain size of 0.25 μm (ratio of AgBr and AgCl 98:2). pH was 6.0 and pAg was 7.5.

The core emulsion obtained was maintained at 60° C., controlled to pH=8.0 with an aqueous sodium hydroxide solution and an aqueous thiourea dioxide solution and an aqueous chloroauric acid solution were added, followed by ripening for 50 minutes to form fog nuclei. After adjustment of pH=6.0, pAg=7.3, an aqueous silver nitrate solution and an aqueous solution containing potassium bromide and potassium iodide were added at the same time. After desalting treatment, 150 mg of 5-mercapto-1-phenyltetrazole was added per 1 mole of silver halide to give an internally fogged Emulsion XV.

This emulsion was found to have a mean grain size (r) of 0.35 μm and σ/r of 0.12.

Emulsion XVIII

The core emulsion obtained in the same manner as in Emulsion XIV was maintained at 60° C., and an aqueous sodium hydroxide solution was added in an appropriate amount, followed by ripening for 50 minutes fot form fog nuclei. After adjustment of pH=6.0 and pAg=7.3, an aqueous silver nitrate solution and an aqueous solution containing potassium bromide and potassium iodide were added as the same time. Ater desalting treatment, 150 mg of 5-mercapto-1-phenyltetrazole was added per 1 mole of silver halide to give an internally fogged Emulsion XVIII.

This emulsion was found to have a mean grain size (r) of 0.34 μm and σ/r of 0.12.

Emulsion XIX

The core emulsion obtained in the same manner as in Emulsion XVI was treated in the same manner as in Emulsion XVIII to form fog nuclei. After adjustment of pH=6.0 and pAg=7.3, an aqueous silver nitrate solution and an aqueous solution containing potassium bromide and potassium iodide were added as the same time. Ater desalting treatment, 150 mg of 5-mercapto-1-phenyltetrazole was added per 1 mole of silver halide to give an internally fogged Emulsion XX.

This emulsion was found to have a mean grain size (r) of 0.34 μm and σ/r of 0.11.

Emulsion XX

The core emulsion obtained in the same manner as in Emulsion XVII was treated in the same manner as in Emulsion XVIII to form fog nuclei. After adjustment of pH=6.0 and pAg=7.3, an aqueous silver nitrate solution and an aqueous solution containing potassium bromide and potassium iodide were added as the same time. Ater desalting treatment, 150 mg of 5-mercapto-1-phenyltetrazole was added per 1 mole of silver halide to give an internally fogged Emulsion XXI.

This emulsion was found to have a mean grain size (r) of 0.34 μm and σ/r of 0.11.

Preparation of test samples and test results:

The surface latent image type Emulsion A (which was prepared by the same manner as in the poly-dispersed emulsion [A] in Example 1) and Examplary compound No. 3 as a polyhydric alcohol were mixed with each of Emusions I, XIII, XIV–XXI to a ratio of 4:1, and the compound represented by the formula [I] was added as shown in Table 5, and the resultant mixture was applied on both surfaces of a polyethylene terephthalate support to a silver quantity of 5.0 g/m$^2$. Further, on these emulsion layers was formed are protective layer by coating of a mixture prepared by adding gelatin, polymethyl methacrylate and a glycidol addition polymer of a phenol-formalin condensate and mixing with film hardening agents of formalin and glyoxal. Subsequently, standard exposure was given through an optical wedge with intervals of 0.15 density and the same processing as in Example 1 was conducted.

The results are shown in Table 5.

As is apparent from the Table, high sensitivity, high Dmax and high gamma can be obtained in the short time developing processing according to the present invention, and yet there is substantially no increase in fog and graininess is also good. Also, it can be understood that the effect of the present invention becomes marked by containing silver chloride in the core emulsion particles.

TABLE 5

| Sample No. | Internal fogged emulsion 1.0 g/m² | Surface latent type emulsion A [g/m²] | Compound mole/mole Ag | Developing solution treatment 2 20° C. for 3 minutes Sensitivity | Dmax | Fog | Gamma | Graininess | Remarks |
|---|---|---|---|---|---|---|---|---|---|
| 19 | — | 7.0 | None | 100 | 3.20 | 0.02 | 2.9 | 5 | Comparative |
| 20 | I | 4.0 | None | 80 | 2.76 | 0.03 | 2.5 | 4 | |
| 59 | XIII | 4.0 | None | 132 | 3.50 | 0.06 | 3.5 | 2 | |
| 60 | XIV | 4.0 | None | 130 | 3.52 | 0.06 | 3.4 | 2 | |
| 61 | XV | 4.0 | None | 130 | 3.50 | 0.05 | 3.4 | 3 | |
| 62 | XVI | 4.0 | None | 124 | 3.48 | 0.05 | 3.1 | 3 | |
| 63 | XVII | 4.0 | None | 120 | 3.48 | 0.05 | 3.0 | 3 | |
| 64 | XVIII | 4.0 | None | 80 | 2.80 | 0.02 | 2.6 | 4 | |
| 65 | XIX | 4.0 | None | 76 | 2.80 | 0.03 | 2.4 | 4 | |
| 66 | XX | 4.0 | None | 74 | 2.60 | 0.02 | 2.4 | 4 | |
| 67 | XXI | 4.0 | None | 70 | 2.42 | 0.02 | 2.2 | 4 | |
| 33 | I | 4.0 | I - 8/1.0 × $10^{-4}$ | 70 | 3.23 | 0.02 | 2.4 | 5 | |
| 45 | XIII | 4.0 | I - 8/1.0 × $10^{-4}$ | 125 | 3.22 | 0.02 | 3.5 | 4 | This |
| 68 | XIV | 4.0 | I - 8/1.0 × $10^{-4}$ | 120 | 3.16 | 0.03 | 3.5 | 5 | invention |
| 69 | XV | 4.0 | I - 8/1.0 × $10^{-4}$ | 118 | 3.22 | 0.02 | 3.4 | 5 | |
| 70 | XVI | 4.0 | I - 8/1.0 × $10^{-4}$ | 110 | 2.70 | 0.02 | 3.0 | 5 | |
| 71 | XVII | 4.0 | I - 8/1.0 × $10^{-4}$ | 106 | 3.18 | 0.02 | 3.0 | 5 | |
| 72 | XVIII | 4.0 | I - 8/1.0 × $10^{-4}$ | 70 | 3.20 | 0.02 | 2.5 | 5 | Comparative |
| 73 | XIX | 4.0 | I - 8/1.0 × $10^{-4}$ | 68 | 3.22 | 0.02 | 2.4 | 5 | |
| 74 | XX | 4.0 | I - 8/1.0 × $10^{-4}$ | 67 | 3.21 | 0.02 | 2.4 | 5 | |
| 75 | XXI | 4.0 | I - 8/1.0 × $10^{-4}$ | 62 | 3.23 | 0.01 | 2.2 | 5 | |

Incidentally, in the above Examples 3 to 5, even when the surface latent image type Emulsion A containing no polyhydric alcohol was employed, substantially the same results could be obtained.

As described above, according to the present invention, a light-sensitive silver halide photographic material capable of giving images of high sensitivity, high contrast and high maxium density is obtained.

According to the present invention, not only a light-sensitive silver halide material of high quality images and small processing dependency can be given by high temperature processing, but also it has been confirmed that excellent effect can be exhibited with small change in sensitivity and gradation in low temperature processing (generally around 20° C., developing time 2 to 20 minutes).

Further, according to the present invention, a light-sensitive silver halide photographic material capable of inhibiting increase of fog particularly during high temperature rapid processing and change in sensitivity and gradation which is extremely increased can be obtained.

In short, according to the present invention, a light-sensitive silver halide photographic material affording constantly stable photographic performance can be obtained.

We claim:

1. In a light-sensitive silver halide photographic material having at least one silver halide emulsion layer on a support, the improvement wherein said light-sensitive photographic material contains light-sensitive silver halide grains, metal salt grains having internal fog and a polyhydric alcohol having at least two hydroxyl groups having a melting point of 40° C. or higher.

2. The light-sensitive silver halide photographic material according to claim 1, wherein said metal salt grains having internal fog is an internal fog type silver halide emulsion having fog nuclei internally of grains.

3. The light-sensitive silver halide photographic material according to claim 2, wherein said internal fog type silver halide emulsion is a core/shell type emulsion prepared by simultaneous addition of an aqueous halide solution and an aqueous silver compound solution after fogging the surface of the silver halide core particles with the use of a reducing agent.

4. The light-sensitive silver halide photographic material according to claim 3, wherein said core/shell type emulsion has a mean silver halide grain size of 0.1 to 0.7 μm and a thickness of the shell portion of 0.01 to 0.3 μm.

5. The light-sensitive silver halide photographic material according to claim 1, wherein said polyhydric alcohol is alcohols having 2 to 12 hydroxyl groups and 2 to 20 carbon atoms in the molecule, and also in which hydroxyl group and hydroxyl group are not conjugated with a conjugation chain.

6. The light-sensitive silver halide photographic material according to claim 5, wherein said polyhydric alcohol is those having a melting point of 50° C. or higher and 300° C. or lower.

7. The light-sensitive silver halide photographic material according to claim 1, wherein said light-sensitive silver halide photographic material contains a surface latent image type silver halide emulsion.

8. The light-sensitive silver halide photographic material according to claim 7, wherein said surface latent image type silver halide emulsion has a mean grain size of 0.5 to 3 μm.

9. The light-sensitive silver halide photographic material according to claim 1, wherein said light-sensitive silver halide photographic material contains a compound represented by the formula shown below:

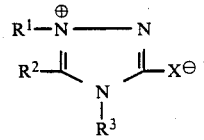

wherein X represents a sulfur atom or =N—$R^4$, each of $R^1$, $R^2$, $R^3$ and $R^4$ represents a hydrogen atom, a substituted or unsubstituted alkyl group, aryl group or heterocyclic group; with proviso that when $R^4$ is a hydrogen atom, $R^1$ to $R^3$ represent other groups than hydrogen atom, and also $R^1$ and $R^2$, $R^2$ and $R^3$, and $R^3$ and $R^4$ may be bonded together to form a ring.

10. The light-sensitive silver halide photographic material according to claim 1, wherein said light-sensitive photographic material contains light-sensitive silver halide grains; an internal fog type silver halide core/shell type emulsion having fog nuclei internally of grains prepared by simultaneous addition of an aqueous halide solution and an aqueous silver compound solution after fogging the surface of the silver halide core particles with the use of a reducing agent; a polyhydric alcohol having at least two hydroxyl groups having a melting point of 40° C. or higher; and a compound represented by the formula shown below:

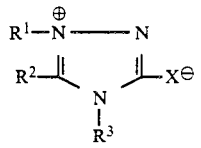

wherein X represents a sulfur atom or $=N-R^4$, each of $R^1$, $R^2$, $R^3$ and $R^4$ represents a hydrogen atom, a substituted or unsubstituted alkyl group, aryl group or heterocyclic group; with proviso that when $R^4$ is a hydrogen atom, $R^1$ to $R^3$ represent other groups than hydrogen atom, and also $R^1$ and $R^2$, $R^2$ and $R^3$, and $R^3$ and $R^4$ may be bonded together to form a ring.

11. The light sensitive silver halide photographic material according to claim 1, wherein said metal salt grains comprise CuBrI grains.

12. The light sensitive silver halide photographic material according to claim 11 wherein the CuBrI grains have a mean size of 0.2 microns.

* * * * *